United States Patent [19]

Franklin et al.

[11] Patent Number: 4,712,653

[45] Date of Patent: Dec. 15, 1987

[54] ENERGY-RECYCLING SCISSORS LIFT

[75] Inventors: Duane R. Franklin, Northridge; Archibald D. Evans, Thousand Oaks; Walter J. Hansen, Woodland Hills, all of Calif.

[73] Assignee: Lift-R Technologies, Inc., Los Angeles, Calif.

[21] Appl. No.: 765,911

[22] Filed: Aug. 14, 1985

[51] Int. Cl.[4] ..... B66B 11/04

[52] U.S. Cl. ..... 187/18; 182/141; 108/145

[58] Field of Search ..... 187/18, 8.71, 8.72; 182/141, 83, 69, 158; 254/122, 9 R, 9 C, 9 B; 108/145, 144, 147; 248/421, 579

[56] References Cited

U.S. PATENT DOCUMENTS

| | | | |
|---|---|---|---|
| 1,630,191 | 5/1927 | Liberman | 182/141 |
| 2,531,140 | 11/1950 | Linde | 108/145 |
| 3,228,659 | 11/1966 | Sturm | 187/18 |
| 4,088,203 | 5/1978 | Smith, Jr. | 187/18 |
| 4,157,743 | 6/1979 | Masada et al. | 187/18 |

*Primary Examiner*—Joseph J. Rolla
*Assistant Examiner*—Kenneth Noland
*Attorney, Agent, or Firm*—Romney Golant Martin Seldon & Ashen

[57] ABSTRACT

An energy-recycling scissors lift includes a platform, base and a pair of scissors linkages, each having a first and second scissors legs. One end of each second scissors leg is pivotally attached to the base and the other end translations along the platform. One end of each first scissors leg is pivotally attached to the platform and the other end translates along the base. A bridge structure connects each of the second scissors legs together. A sealed gas cylinder, attached to the base and the bridge structure, moves the platform to an extended position above the base. Energy is stored in the sealed gas cylinder as the platform and supported object descends to a retracted position. A compensating device is attached to the scissors lift to compensate for the overforce caused by the sealed gas cylinder. One form of the compensating device adjusts the position of the sealed gas cylinder to vary the force exerted on the platform. Other compensating devices are equalizing springs and spring reels. The scissors lift includes a device for adjusting the maximum height of the platform and a shipping boss that permits the scissors lift to be compacted for shipping.

35 Claims, 19 Drawing Figures

ENERGY-RECYCLING SCISSORS LIFT

BACKGROUND OF THE INVENTION

1. FIELD OF THE INVENTION

This invention relates generally to scissors lifts and more particularly to such lifts adapted for use in repetitively raising and lowering items of furniture, home entertainment devices, office equipment, and other such articles. Some preferred embodiments of the invention repetitively raise and lower such articles in such a way as to provide access to the article when it is in a raised position and concealment when it is in a lowered position.

Although the invention is by no means limited to domestic or office usages, for convenience in this document it is sometimes referred to as a cabinetry lift.

2. PRIOR ART (a) Scissors Lifts: General History

Many ingenious people have developed ways to use scissors mechanisms to raise or extend platforms, baskets, and scaffolds carrying various sorts of payweights. In particular several patents have addressed the problems encountered in initiating the extension of a scissors mechanism from a fully retracted or folded position. These patents will be identified below, and the reason for the initial-extension problem will be discussed.

As will be seen, however, none of these patents has dealt with the detailed behavior of a scissors mechanism at the opposite end of its operating range—that is to say, in its extended position—or even in the midregion between the extended and retracted positions. In the prior art, an extended scissors mechanism is retracted simply by removing, reducing or even reversing the primary driving force: the mechanism readily starts down. Moreover, the apparatuses used for application of external driving force to a scissors mechanism generally accommodate a relatively wide variation of resistance from the scissors mechanism; they simply pump in more energy. Thus, once the problems that occur near the retracted position have been solved, there has been no need to be concerned with the magnitude of the lifting force at the other end of the operating range.

(b) Tension-extended Scissors Systems

Perhaps the "first generation" of scissors lifts is typified by U.S. Pat. Nos. 1,078,759 and 1,817,418. The first of these issued in 1913 to Arend Wichertjes, and the second in 1931 to Arthur Munns. Both disclose multiple-stage scissors lifts—or, as they are sometimes called, "lazy tong" mechanisms. These are scissors lifts in which one "scissors" linkage drives another above it, which in turn may drive yet others.

Wichertjes and Munns respectively describe chain-controlled and cable-controlled scissors lifts. In each case the chains or cables are wrapped around the lateral pivots (and across the central pivots) of the successive scissors linkages. When tensioned, the chains or cables pull the lateral pivots together to extend the lift.

Wichertjes notes that "it might result in undue stress and strain upon the lazy-tongs to rely upon the chains . . . alone for extending the device and elevating the platform," and accordingly he provides an "auxiliary elevating device". The "stress and strain" to which Wichertjes alludes apparently arise from the fact that when a force that is purely lateral, or almost purely lateral, is applied to open or extend a *fully* folded or retracted scissors mechanism, there is a strong tendency for the mechanism to bind rather than to extend. When this happens, if the forces applied are increased the result is often to break something rather than to extend the mechanism.

The binding can be understood by studying the mechanism. The forces on the rigid members are directed almost exactly within and parallel to the lengths of those members, with at most a very small component of force directed perpendicular to the rigid members to rotate them about their pivot points. Often the "rigid" members of a *loaded* scissors mechanism that is fully folded are slightly deformed (bent or twisted) by the load, causing the rotational-tending force to be actually zero. Sometimes these forces are even caused to be applied in a direction that tends to rotate the arms to a *more* tightly folded position. Only when the scissors is partly open does there develop a sizable component of force directed to rotation in the proper direction and thereby further extension.

Though Wichertjes does not say so, the tendency to bind is actually a special case—or an extreme manifestation—of the strongly varying mechanical advantage which a scissors mechanism presents to its driving force. When the driving force is applied to pull the ends of the legs at one end of the scissors straight toward each other the mechanical advantage between the driving force and the weight to be moved at the far end of the scissors varies as the *tangent* of the angle between the legs and (for a vertical scissors) the horizontal.

When the scissors mechanism is fully folded this angle is very nearly zero, the tangent and thus the mechanical advantage are likewise, and only a tiny fraction of any input force is therefore available to open the scissors (the rest, as already observed, being applied to break something).

Wichertjes resolves this impasse by providing a completely separate chain-driven mechanism for raising part of the scissors linkage vertically in preparation for operating his main mechanism to extend the scissors by pulling its opposite pivot points together as previously described. Wichertjes' entire device generally is disadvantageous by virtue of being almost startlingly complicated or elaborate, and seemingly impractical by virtue of this intricacy.

Munns also directs his attention to the initial-extension problem, but he ascribes it (somewhat inaccurately, it would appear) to inadequate available "power" —rather than to the tendency to bind. He observes, "The mechanisms heretofore proposed for moving the lazy-tongs to extended position from a folded position have been such as to render very difficult the initial actuation thereof to the extent of requiring a relatively greater source of power and one wholly beyond the range of practicability particularly where the elevator is a portable one and great loads are adapted to be lifted." He adds that "although the pulley and cable mechanism thus far described is sufficient to move the lazy-tong structure when dealing with light loads, it is incapable of initiating movement of the lazy-tong structure when elevating relatively heavy loads."

Although Munns' text at some points appears inaccurate as to the problem which he is trying to solve,his text at other points is quite accurate as to the means applied to solve it: "the pulling force which may be said to be acting horizontally is . . . converted into a vertical force which operates to move the arms upward." By referring to "force" rather than "power", Munns here correctly focuses on the previously described adverse behavior of the mechanical advantage of a scissors mechanism at small angles. Whereas ample power may be available, the scissors mechanism misdirects the available force.

Munns' conversion redirects the line of action of the available force so that it can perform the desired work. Munns effects this conversion by separate members fixed to two of the scissors arms and extending a substantial distance downward from them, and pulley wheels at the lower ends of these arms; the cables crossing the bottom scissors stage are passed under these two pulley wheels, causing each cable to assume a "V" shape and thus creating a large vertical component of tension. This tension tends to raise the wheels, and operates the mechanism out of the range of positions in which binding is a serious problem—whereupon the primary mechanism takes over. Munns' device suffers from the severe disadvantage that his downward-extended extension members are very awkward or cumbersome, and in particular prevent collapsing the mechanism to a very shallow configuration.

Even after the Wichertjes or Munns mechanism has been elevated past the point at which binding is a serious problem, the adverse (that is, very low) mechanical advantage at small angles continues to require relatively large force levels for extension of the mechanism. Notwithstanding Munns' above-quoted comments, such force levels generally can be obtained through gearing. Nevertheless, the requirement of large forces can be a particularly severe problem if these forces must be borne by cables or chains in tension, since very strong (and therefore large-diameter and heavy) cables or chains are thereby required, and the apparatus as a whole must be very large, bulky, heavy, and expensive. The weight and expense of the necessary gearing further aggravates these factors.

Hence the auxiliary lifting arrangements of the Wichertjes and Munns devices are used to move the mechanisms not only out of the dead zone in which the scissors actually bind, but also past the range of positions in which the mechanical advantage is so unfavorable that (1) the driving force would be stalled, and/or (2) excessively heavy-duty force-transmitting elements would be required. It is emphasized that these devices of the prior art both operate by *externally supplied* energy, of which—in the past—the availability of an ample amount has generally been assumed. The auxiliary devices described merely serve to optimize the coupling of this *externally supplied* energy to drive the scissors Once the scissors legs in these mechanisms have moved a few degrees from the vertical, however, the auxiliary mechanisms are no longer needed. Even if stopped, the scissors can then be driven upward by the primary driving-energy source provided. In particular, neither Munns nor Wichertjes is concerned with reversing the direction of the mechanism from the fully extended position, since reversal is easily accomplished by removing, reducing or reversing the force applied to the driven end of the scissors. A "second generation" of innovations in scissors mechanisms is offered by U.S. Pat. No. 4,391,345, which issued to Jim Paul on July 5, 1983. This patent discloses a much smaller, simpler, and more sophisticated approach to supplying the vertical component of force necessary to initiate extension of a cable-driven three-stage scissors mechanism.

Paul's device uses an eccentrically pivoted sheave a few inches in diameter, mounted to the scissors mechanism near the bottom. The sheave is readily rotated by the tension in the driving cable. It acts as a cam, raising the scissors legs through a few degrees of rotation and thereby past the region of very adverse mechanical advantage.

Paul suggests that the abandonment of cable-driven-scissors devices earlier in the century, in favor of hydraulic-cylinder-driven scissors devices, may have been due to the complex, cumbersome character of auxiliary apparatus used for the initial extension by inventors such as Wichertjes and Munns. Paul goes on to propose that his simpler and more compact initial-extension unit restores the cable-driven scissors to the realm of competitive practicality, since hydraulic systems are by comparison very heavy and expensive to operate.

However this may be in the field of large, vehicle-mounted, multiple-stage platform lifts, cable-driven systems are distinctly disadvantageous in the area of cabinetry lifts intended for high-volume manufacture and for final assembly in homes and offices by mechanically unskilled users or relatively unspecialized technicians. Cable-driven systems are characterized by a relatively large amount of manufacturing labor and inventory costs, because of the numerous small parts (particularly pulleys) that are involved. They also require a relatively large amount of final assembly work, and this work requires some level of specialized skill because of the necessity to thread the cables correctly and ensure that there are no snags. In addition cable-driven scissors lifts tend to be slow and rather noisy.

Nevertheless the principle of Paul's invention appears in modern devices, such as the line of electrically powered and cable-driven scissors lifts marketed by the firm Hafele America under the trade name "Open Sesame electric hideaway lift systems".

The Paul patent and the principles of the Hafele apparatus, like the earlier units previously discussed, are unconcerned with the details of operation of the scissors in the extended position. The purpose of the auxiliary devices in all these units is to facilitate operation near the retracted position of the scissors.

(c) Compression-extended Scissors Mechanisms

Preceding and paralleling Paul's innovation is the development of scissors mechanisms that are self-extending, driven by hydraulic cylinders or by electrical motors and screws. Generally at least one stage of the scissors mechanism in such devices is driven by pushing or pulling the legs together at one end, as in the cable-driven devices discussed previously; consequently the comments offered earlier regarding the tangent variation of mechanical advantage apply to these apparatuses as well.

U.S. Pat. No. 2,471,901 to William Ross, issued May 31, 1949, discloses one such system. Ross's apparatus provides a tiltable platform, one end being supported by a two-stage scissors. (It is a full or true scissors to the extent that it raises both stages vertically, though the upper or second stage is only a partial scissors in the sense that it does not hold the platform horizontal.) The other end is supported by an extension linkage that does not hold itself vertical as does a scissors. Only the former of these two mechanisms, accordingly, is pertinent to the present discussion.

Ross provides two features to mitigate the adverse mechanical advantage of the scissors mechanism in its retracted condition. First, he applies driving force from his hydraulic cylinder to a forcing point that is offset from the driven leg of the scissors; this geometry provides some rotation-tending component of force even when the mechanism is fully retracted. Second, Ross provides a second hydraulic cylinder which is mounted for purely vertical motion, to raise the first stage of the scissors bodily out of the low-mechanical-advantage region.

The primary and auxiliary hydraulic cylinders are both driven by a hand-cranked oil pump, to raise the scissors and payweight.

First, as to the offset forcing points, Ross mentions that his primary hydraulic cylinder acts on "off-set torque-lugs", apparently to aid mechanical advantage near the fully retracted position. From his drawings it appears that each forcing point is spaced from the rotational axis of the bottom of the respective leg by nearly half (about 0.46) of the length of the leg, and is offset approximately seventeen degrees (about the rotational axis) from the respective leg. The magnitude of these values has certain significance, which will be discussed later.

Second, as in Paul's cable-extended device, the auxiliary driving mechanism of Ross's hydraulic system—namely, Ross's vertical auxiliary cylinder—is provided:

"owing to the dificulty encountered at the point of substantially zero lift when the carriage . . . is in its lowermost position . . . . [W]hen the upward travel of the carriage is initiated, the two piston-rods]. . . aid the main cylinders and their piston-rods until the limits of travel of the former have been reached at which time the main hydraulic means will be in such angular relation as to be properly effective to complete the lifting movement of the carriage.

"Stated somewhat otherwise, the primary use of these 'booster' or supplementary, upright, hydraulic means is to aid the 'breaking' or starting of the upward motion of the pantograph-linkages . . . ."

Thus the auxiliary device is not intended to serve any function relating to operation in the *extended* position of the scissors.

Furthermore, when the apparatus is to be lowered from the extended position, this function "is accomplished in the usual manner by means of release valves of conventional design . . . " In other words, the primary driving force is removed, and the weight on the platform lowers the scissors.

Moreover, also paralleling the cable-driven scissors disclosures, Ross's hydraulic unit deals with the variation of mechanical advantage in the midrange and extended positions of the scissors simply by supplying the varying force required to support the payweight.

Another patent in this area is U.S. Pat. No. 3,750,846, which issued Aug. 7, 1973, to Thomas Huxley. This patent discloses a multistage scissors that is driven either by an electric motor in combination with a screw or by a hydraulic cylinder. The first stage of the scissors in Huxley's device is not driven by pulling or pushing the legs together, but rather by pushing straight outwardly on the center pivot of the first stage. Nevertheless, the first stage necessarily extends the second stage by pulling the legs of the second stage together, so the previously discussed problems of mechanical-advantage variation are not completely eliminated. Due to play in the mechanism, the tendency for the outer stages to bind is as serious in Huxley's device as in those of Wichertjes and Munns.

Huxley responds to this difficulty by providing a separate device for boosting the last stage of the scissors out of its retracted or folded condition. This device is a spring which is compressed by a small part of the travel of the last stage during retraction—that is, just the last fifth or fourth of the travel. The spring stores the compression energy, and is sufficient to carry the full load of the payweight basket; it tends to drive the last stage out of the fully retracted condition. This tendency, however, is offset by the retracted condition of the adjacent stages of the scissors.

The tendency to extend the last stage, however, is used when the time comes to extend the entire mechanism. In effect, as Huxley explains, "Unfolding forces . . . commence at opposite ends of the boom structure and work towards the center . . . greatly facilitating the successive opening of the crossed links beyond critical angles . . . " The critical angles of which Huxley speaks arise, apparently, from distortion of the individual links, rather than from driving geometry.

Like the patents previously discussed, Huxley's is concerned with unfolding of his scissors mechanism from its fully retracted condition. Inspection of Huxley's disclosure reveals no passage directed to the detailed operation of the mechanism when it is extended.

(d) Scissors Mechanisms: Other Factors

The Munns, Paul and Huxley patents represent a "second generation" of developments in the scissors-mechanism lift field. They are directed to producing optimum performance in terms of reliability and convenience.

Modern users of equipment, however, demand more than this. The present age is extremely conscious of the usage of *energy*, particularly nonrenewable energy sources. The modern age is also extremely conscious of the usage of *materials*, particularly metals, and of hand *labor*. It is furthermore extremely conscious of the usage of *space* since the per-square-foot cost of usable home, office, and even light industrial space has skyrocketed in the last decade. Even the *weight* of equipment itself can be a critical factor, since shipping cost and ease of installation depend on this characteristic.

It has therefore become a matter of paramount concern to all manufacturers, and certainly to manufacturers of lifts intended for high-volume manufacture and for use in expensive home and business square footage, that apparatus be efficient in terms of labor, energy usage, space, materials, and shipping weight—while the equipment remains just as reliable and convenient as before.

Perhaps less plain, but equally significant in terms of energy and materials efficiency, is the undesirability of making several different models of lifts for use with articles of different weights—or, in other words, for different "payweights". It is desirable to standardize as much of a lift mechanism as possible, leaving a bare minimum of different submodules that must be changed to accomodate different payweights.

The use of different payweights arises from the infinitely various types of articles which end-users may wish to see repetitively raised and lowered. Thus it is neither possible nor particularly desirable to eliminate nonuniformity of payweights in use.

Yet there are many inefficiencies in the practice of manufacturing substantially different lifts for different payweights. Such inefficiencies extend through warehousing, spare-parts maintenance, billing and bookkeeping systems, and communications complexity all along the distribution chain from manufacturer to user.

(e) Energy-recycling Systems: General Introduction

In another field, the field of mechanical energy-storage devices, certain basic developments have arisen which have never been used in scissors lifts. It is not clear whether it has ever previously occurred to anyone skilled in the art of lift mechanisms to attempt to provide a scissors mechanism in combination with an energy-storage device, to recycle the energy released in lowering a payweight for the purpose of raising the same payweight subsequently.

One special kind of energy-storing lift that *has* been developed is a vertically acting cable-counterweighted lift, similar to an elevator or dumb waiter. This type of device does not involve a scissors mechanism. The energy in this type of device is stored as potential energy of height of the counterweight. Such devices, as previously noted for cable-driven scissors lifts, are disadvantageous by virtue of the need for several pulleys and the need to thread cables correctly. The resulting cost and labor requirement makes such devices undesirable in comparison to a scissors lift.

Thus the energy-storage approach has distinct appeal for use in scissors lifts.

(f) Energy-recycling Systems: Springs

One basic energy-storage device is of course the common mechanical spring. Springs are used in a wide variety of applications to "balance" various kinds of objects that are repetitively moved: the general goal is for the spring generally to *support* the object while relatively small forces are supplied externally to *move* the object.

As is familiar to almost everyone in modern society, this goal is only marginally reached. The most common example is the spring suspension of horizontally pivoted (that is, vertically acting) doors, and particularly garage doors. The pervasive commercial success of automatic openers for garage doors is, in part, testimony to the incomplete ability of springs to balance large, heavy objects throughout their complete operating range.

The reason for this limitation apparently resides in the typical force-versus-travel characteristic of a spring: the force varies quite steeply with displacement (as a fraction of spring length) from the at-rest position of the spring. Suspension of a heavy object through a long displacement consequently requires use of a very long spring (so that the displacement can be made a relatively small fraction of the spring length). Thus garage-door suspension springs, despite clever use of mechanical linkages to minimize the necessary spring displacement, are typically three or four feet long.

Another disadvantage of springs is that if they break or lose their anchorage and whip around—or even if they are used with inadequate planning for unexpected release of the spring-driven mechanism—they can cause severe damage or injury. Garage-door suspension springs are at least favorably positionable on the opposite side of the door from the person moving the door, but this advantage is not available in many applications where it might be desirable to install lifts.

These limitations are particularly salient in the field of cabinetry lifts for indoor use, since space is at a distinct premium and it is difficult to arrange a single spring with sufficient travel to suspend a heavy object. The limitations of springs are also salient in this same field, and in the broader field of repetitively acting lifts, since in these fields it is typical for valuable and relatively fragile objects to be positioned—and for personnel to work—near the mechanism on a regular basis.

It is undoubtedly for these reasons that energy-recycling scissors lifts using springs are unknown. Even linearly, vertically acting lifts or jacks relying upon springs to recycle energy are not in common use, although they have been in the patent literature for many years. U.S. Pat. No. 727,192 (issued May 5, 1903 to Olen Payne) and U.S. Pat. No. 3,007,676 (issued Nov. 7, 1961 to Laszlo Javorik) each describe a vehicle jack with a spring that is compressed beforehand, storing energy for use in raising a vehicle. Mere brief speculation on the workings and typical uses (and users) of such articles suffices to explain their commercial nonexistence.

(g) Energy-Recycling Systems: Gas Cylinders

A recent innovation commercially is the permanently sealed gas cylinder, which contains a fixed quantity of gas (subject to very slight leakage, over a service period of several years) and which exerts an outward force on a piston. These gas cylinders are to be clearly distinguished from the earlier and better-known pneumatic and hydraulic cylinders that must be connected through valving to pressure sources—such as compressors, compressed-gas tanks, or pumps (as in the Ross patent).

An interesting aspect of these devices is that the force-versus-travel characteristic can be, and almost always is, made extremely shallow. In fact, the force is usually made very nearly independent of varying position of the piston, over the operating range of the apparatus in which the cylinder is installed. In this way practically constant force is made available for the purposes of the apparatus. A manufacturer of these gas cylinders is the West German firm Suspa-Federungstechnik GmbH, of Altdorf.

Each cylinder contains a small amount of oil, in addition to the driving gas, for the purpose of lubricating the action of the piston in the cylinder—and also for the purpose of controlling the speed at which the piston reacts to changes in adjustment or externally applied forces.

These cylinders have been used in such applications as supporting automobile hatchbacks and controlling office-chair seat heights. As can be readily understood, the shallow force-versus-travel characteristic of the devices is quite useful in such units. In some units for use in office chairs, the force-versus-travel curve for these devices is modified by changing the amount of oil, or in other ways, to superpose a relatively steeply rising segment at short cylinder extensions. Doing this provides a cushioning effect as users of the chairs sit down.

If it ever previously occurred to anyone to use such cylinders in connection with cabinetry lifts generally or with scissors lifts in particular, the idea would very likely be dismissed out of hand, for reasons to be set forth in the discussion of the invention.

(h) Summary:

The foregoing comments show that there has been a need in the cabinetry-lift industry for a third generation of scissors lifts, one that is (1) substantially more compact, simpler in construction, and lighter in shipping weight than those of the second generation but (2) at least as convenient and reliable, and (3) capable of accommodating any payweight with minimal change of components. This need arises from considerations of energy, labor and materials efficiency, and efficiency in general, and also from considerations of reliability in use.

These comments also show that the concept of (4) recycling the energy used in repetitive raising and lowering of the payweight has some tantalizing benefits for the scissors-lift industry, but that this concept has never been applied to scissors lifts.

SUMMARY OF THE INVENTION

The present invention is directed to a third generation of scissors lift equipment. It provides an efficient, light weight, energy-recycling lift, which therefore requires essentially no power to operate. Nevertheless, it is just as sturdy as previous lifts is at least as compact and convenient, and is substantially faster, simpler and quieter.

Moreover, this invention makes it possible for just one lift model to be used for virtually any payweight, with a simple, easy effective change of just one component, an improvement which produces very significant economies in construction, warehousing, distribution and maintenance as well as giving users more options for the use of their equipment.

The present invention includes an upper support member and a lower support member which are designed as a platform and a base respectively. The platform is adapted to support and bear the weight of the supported article. In fact, if the lift is permanently dedicated to the article, the platform can be manufactured as part of the article itself. In such situations, the platform need not be a customary planar platform structure but may be, generally speaking, part of the framework or chassis of the article to be supported. The base comprises of a relatively planar sheet of sturdy material which rests on a supporting surface.

The invention also includes a pair of scissors type linkages interconnected to the base and the platform. Each scissors linkage is a mechanism that has a first and second scissors leg pivoted together near their centers by a pivot pin, or other suitable fastener. Each of the first scissors legs are arranged so that one end of the scissors leg is pivotly mounted to the platform with the other end free to translate along the base. Each of the second scissors legs are pivotally attached to the base with the opposite end of the scissors leg free to translate along the platform while in operation. The end of each scissors leg which translates along the base or platform has roller means such as a wheel pivotally connected for rolling engagement with the base or platform.

In accordance with this invention, the scissors linkages are adapted to exert upward forces upon the platform and the article to maintain the platform and article in an upper extended position. The linkages are also adapted to maintain the platform substantilly horizontal regardless of the height of the platform above the base.

The invention also includes a mechanical energy-storage means which is secured to the base and scissors linkage to store energy when the article and the platform are lowered to a retracted position and to move the platform and article upward from the retracted position toward an extended position. An attachment-structure means which serves as an intermediary between the scissors linkages and the energy storage means is attached to each of the second scissors legs. This attachment-structure means, which appears as a bridge structure in the preferred embodiment, passes the potential energy of the elevated article to the energy-storage means as the energy is released in the descent. The bridge structure also passes the stored energy back to the scissors linkages when the platform and article are raised back to the upper extended position In the preferred embodiment of the invention, the mechanical energy-storage means is a gas sealed cylinder having one end that is pivotally fixed to the bridge structure and another end that is pivotally attached to a boss which is located on the base. In operation, the gas sealed cylinder receives the potential energy of the elevated article and the platform as the platform and article are moved to the retracted position and releases the energy when the platform and article are moved to their fully extended position. Through the combination of these elements, energy drawn from the gas sealed cylinder is made to bear the combined weight of the platform and the article on the platform and to raise the platform and article to the extended position.

The phrase that has just been used, "bear the combined weight . . . to raise", is intended to describe any of several situations. First, it includes the situation in which the energy from the energy storage means produces an upward force at the platform which exceeds the platform weight plus payweight, when the scissors is retracted (though not necessarily at all positions of extension), so that the energy storage means is capable of starting the payweight upward.

In this situation the platform typically must be held down by a small mechanical catch or the like, or by a small electrical motor or a small hydraulic or pneumatic cylinder, externally driven—and this hold-down provision must be released to initiate the upward motion. The energy available from the storage means must be coupled to the platform by the bridge structure means in such a way that the platform, once started upward, will continue to its maximum extension within the operating range. This may be accomplished by having the resultant force *exceed* the payweight plus platform weight at these positions:

(a) at all points in the operating range; or (b) in and near the retracted position, and in the extended position, but not at all intermediate positions—in which case upward travel through the intermediate positions is effectuated by upward momentum gained near the retracted position; or (c) in and near the retracted positin, but not at the extended position—in which case upward travel all the way to the extended position is effectuated by upward momentum gained near the retracted position, but the platform once having reached the extended position would descend if permitted, and so must be held at the top by some otherwise applied force, as for example by a mechanical catch.

In cases a and b the payweight and platform must be started down by applying downward pilot force as by a user's pressing downward on the article or by application of force from a small, remotely controlled motor, or conventional hydraulic or pneumatic cylinder. In case c it sufficies to release the catch, or otherwise remove the restraining force applied.

There is a second group of situations included with in the phrase "bear the combined weight . . . to raise": here the energy-storage means almost—but not quite—produces a platform force sufficient to start the platform upward. Only a relatively small increment of pilot force is required to begin the motion. Once the motion is begun and has proceeded through a range of positions near the retracted position, again it may continue to the top of the operating range even thought the pilot force is discontinued, or it may be made to require continued application of a pilot force, depending upon the constraints of the particular use and the preferences of the designer or user. These upward forces may be provided manually by a user or by the action of a small motor or an externally driven cylinder, as discussed before.

Yet a third group of situations is meant to be covered by the phrase under discussion. In these situations the platform starts up by itself—when the downward-restraining provision is released—but at some part of the operating range the net upward platform force is less than the payweight plus platform weight, and there is inadequate momentum to continue the motion. Therefore the motion ceases part way up and must be continued by upward pilot force applied in ways previously described.

As previously pointed out, the scissors lift has a mechanical advantage, relative to the weight of such an article on the platform, that varies strongly over the operating range. The mechanical advantage varies, in fact, as the tangent of the scissors leg angle, if the driving force is applied to pull the driven ends of the legs straight toward each other. When other driving geometry is used, the variation may not go as the tangent, but generally is strong.

The present invention also includes some means for at least partially compensating for the variation of the mechanical advantage. This compensation means, in accordance the present invention, reduces the amount of extra upward force exerted on the platform by the energy-storage means. Generally, the energy-storage means bears the combined payweight and platform weight in both the retracted and extended positions of the scissors, usually with a larger overforce in the extended position. The compensating means makes it possible to reduce the amount of overforce in the extended position but yet still permits the storage means to repetitively raise the platform and payweight. Usually, the scissors lift build with an appropriate compensating means requires only a small upward or downward pilot force to raise or lower the platform and payweight.

In one embodiment of the present invention, the compensating means comprises a weight adjustment mechanism which is attached to the attachment-structure means (bridge structure) that is connected to the legs of the scissors linkages. The weight adjustment mechanism is also attached to the end of the gas sealed cylinder and is adapted so that the mechanism can change the position of the cylinder in order to change the mechanical advantage characteristics of the lift apparatus. By providing a weight adjustment mechanism to the invention, the "overforce" at the extended position can be reduced or decreased accordingly, dependent of course upon the weight of the payweight placed upon the platform. To this extent, the weight adjustment mechanism allows the lift apparatus to be "fine tuned" to produce a sufficient force that maintains the platform and object in its extended position but results only in a small "overforce," resulting in a scissors lift apparatus which can be easily started down to its retracted position. The weight adjustment mechanism also adjusts for the upward force needed to start the platform towards its extended position, again reducing the amount of pilot force needed to raise the scissors lift apparatus.

Other preferred embodiments also include provisions of a compensating means, in the form of improved offset forcing point geometry. These include the usage of equalizing springs and spring reels which are attached to the scissors lift to compensate for the mechanical advantage that would normally produce an extremely high level of "over force" at the extended position.

The present invention also incorporates an advantageous structure on the base which is used to vary the height of the platform at its extended position without effecting the horizontal position of the platform. This structure appears as vertical side-walls along the base which extend along the line in which the first scissors legs traverse. Each side-wall include a horizontal top piece which helps form a channel in which each wheel on the scissors leg travels. A similar structure may also be formed on the platform. Each side-wall has a plurality of spaced bores which receive a stopper which engages the wheel to prevent the leg from traveling any further along the base. Since the scissors legs can traverse no further, the platform will extend no further and thus, a maximum height is defined. The stopper can be placed in any of the bores to vary the maximum height of the platform.

A shipping boss is also use in accordance with the present invention. This boss comprises a pair of parallel plates welded or suitably affixed to the base, the boss being adapted for pivotal attachment to the end of the gas sealed cylinder. Each plate has a J-shaped slot which extends from one end of the plate where it extends vertically downward to define a notch that is used to permanently retain the fastener that holds the end of the cylinder during use. When the unit is initially shipped, the end of the cylinder is located in the upper portion of the slot to permit the base and platform to be fully collapsed. Once the user receives the unit, the platform can be raised to its extended position whereupon the end of the cylinder extends along the slot until it reaches the lower notch on the J-slot, where it will permanently remain during usage.

The use of the elements comprising the scissors lift along with the compensating means produces a lift which is particularly strong and durable. The weight adjustment mechanism is particularly advantageous since it permits the unit to be adjusted to produce a lift apparatus which requires only a small force to either raise or lower the platform and the supported article. Additionally, the present invention provides an advantageous scissors lift apparatus that is relatively simple to construct, much more reliable than conventional lift devices and is relatively inexpensive to manufacture.

BRIEF DESCRIPTION OF THE DRAWINGS

A complete understanding of the present invention and other advantages and features thereof may be gained from a consideration of the following description of the preferred embondiments taken in conjunction with the accompanying drawings in which.

DETAILED DESCRIPTION OF THE PREFERRED EMBODIMENTS

Figure 1:
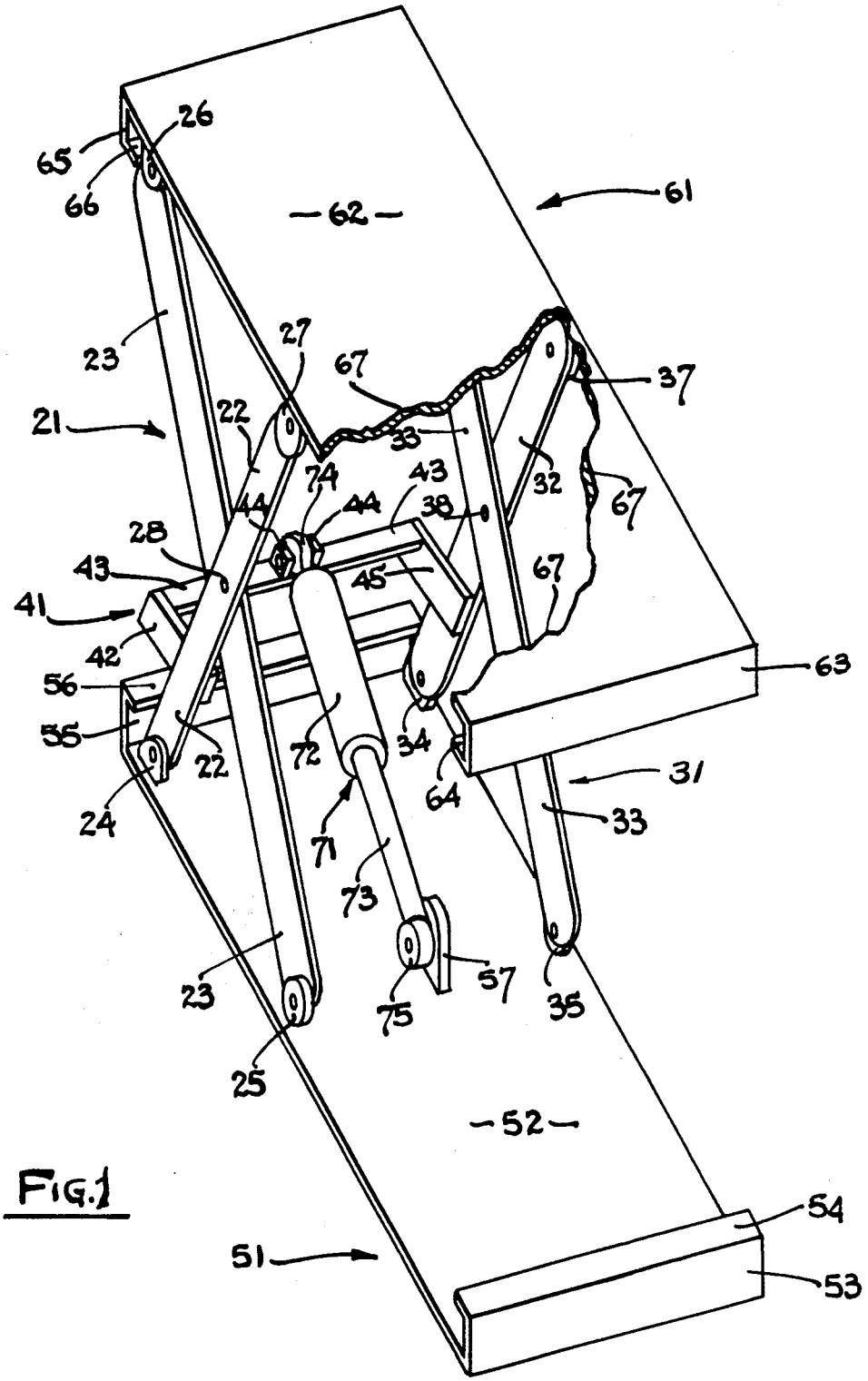
FIG. 1 is an isometric view of a preferred embodiment of the present energy-recycling scissors lift apparatus, in which the energy-storage means is a gas sealed cylinder. The lift apparatus is shown extended, and its upper platform is drawn partially broken away for a clearer view of the mechanical details.

While the present invention is susceptible of various modification and alternative constructions, the embodiments shown in the drawings will herein be described in detail. It should be understood, however, that it is not the intention to limit the invention to the particular form disclosed; but on the contrary, the intention is to cover all modifications, equivalences and alternative constructions falling within the spirit and scope of the invention as expressed in the appended claims Referring initially to FIG. 1, an energy-recycling scissors lift in accordance with the present invention includes an upper support member shown as a platform 61, a lower support member shown as a base 51, a first scissors linkage 21 and a second scissors linkage 31.

The scissors lift 20 also includes mechanical energy storage means shown as a sealed gas cylinder 71 and an attachment-structure means that serves as means for repetitively receiving energy derived from the retraction of the scissors mechanisms and for storing this energy in the energy-storage means. This attachment-structure means is shown as a bridge structure 41 which serves as an intermediary between the scissors linkages and the energy-storage means, passing the potential energy of the elevated article to the energy storage means as that energy is released in the descent. The bridge structure 41 also, as previously mentioned, passes the stored energy back to the scissors linkages for use in raising the platform and its payload to its extended position.

The scissors lift is arranged so that the platform 61 undergoes vertical motion from a relatively retracted position near the base to a relatively extended position above the base An article 86 (FIGS. 2 and 3) to be repetitively raised and lowered is placed on the platform 61, and may be secured to the platform. The scissors linkage 21 includes a first scissors leg 22 and second scissors leg 23 and the other scissors linkage 31 includes a first scissors leg 32 and a second scissors leg 33. These scissors legs are used to raise the platform and article in a vertical fashion. The base 51 is made as a unitary piece of heavy guage sheet metal, most of which rests horizontally on a supporting surface to form a floor section 52. The metal is bent upwards at both ends to form stablizing corner edges. The resulting upright end pieces 53 and 53 are bent inwards to form short horizontal sections 56 and 54, respectively to avoid exposing metal edges at the tops of the upright end pieces.

The platform, very similarly, is made as a unitary piece of sheet metal, most of which is formed as a horizontal section 62 (drawn partially broken away at 67 to permit a fuller view of the mechanism below) having downward end pieces 63 and 65 and two short inward horizontal sections 64 and 66 respectively. Welded or otherwise suitably attached to the undersurface of the platform are bosses for pivotal attachment to the tops of the scissors legs 23 and 33, one of the bosses shown at 26 in the drawings, the other being out of sight beneath the far corner of the platform 61 in FIG. 1.

Also welded or suitably attached to the base floor section 52 near its opposite edges, and near one upright end piece 55 are upright end bosses 24 and 34 for pivotal attachment to the scissors legs 22 and 32 respectively. Also welded or suitably attached to the base 51 near its center is another upright boss 57 for a pivotal attachment to one end of the gas cylinder 71.

The first scissors linkage 21 includes a first scissors leg 22 and a second scissors leg 23 located at one side of the base and platform, the scissors legs 22 and 23 being pivotally connected together near (but not necessarily at) their centers, using a pivotal connector, such as a solid rivet 28. The connectors used to pivotally connect the ends of the scissors legs 22 and 23 to the bosses 24 and 26 may be made from pinned or short clipped axles riding in bushings, or by using nut and bolt assemblies or rivets, or any other means appropriate to create the desired quality and performance of the finished product. The second scissors linkage 31 also includes a first scissors leg 32 and a second scissors leg 33 likewise pivoted together by a connector such as a rivet 38 or a like fastener. Similarly, the ends of the scissors legs 32 and 33 are pivotally connected to the bosses on the platform and base by using fasteners such as nut and bolt fasteners, rivets or any other fastener which will permit the scissors legs to pivot relative to the bosses.

Piviotally connected to the lower ends of the legs 23 and 33, and to the upper ends of the legs 22 and 32, are roller means such as wheels 25, 35, 27 and 37. The lower two wheels 25 and 35 roll along the upper surface of the base flooring 52 and the upper two wheels 27 and 37 roll along the under surface of the platform horizontal section 62.

The bridge structure 41 is shown in FIG. 1 as it is attached to the second scissors legs 22 and 32. The bridge structure includes a pair of bridge arms 42 and 45 which are short pieces welded or suitably attached to the scissors legs 22 and 32. A bridge bar 43 is likewise welded or suitably attached to the bridge arms 42 and 45 to form a support bar on which one end of the gas sealed cylinder is pivotally attached. A pair of brackets or lugs 44 are affixed on the bridge bar 43 for pivotally attaching the end of the gas cylinder to the bridge structure.

The lengths of the scissors legs and their pivoting arrangement are all designed to support the platform in a horizontal fashion, or substantially horizontally as the scissors mechanisms extends and retracts.

Sheet metal 1/16 to 3/32 of an inch thick is usually adequate for the construction of the base and platform for most purposes, with proper design. During operation very large forces, sometimes as large as two to four times the weight of the article on the platform, arise within the scissors lift, particularly when the platform is nearly retracted. It is essential to provide suitably strong material, and if necessary suitable reinforcement, to safely accommodate these forces. In this regard, it may be practical to provide vertical side walls with horizontal pieces (illustrated in FIG. 15) along the base and platform to create stabilizing edges which extend along the long dimensions of both the base and the platform. This greatly increases the stability of the platform and base.

Both the platform and base are unitary pieces of sheet metal which have the respective upward and downward end pieces and horizontal sections formed by bending the sheet metal at the respective locations. Also, the vertical side walls and horizontal pieces on the base and platform (FIG. 15) are also formed by bending on the sheet metal, as opposed to being formed from stock pieces welded to the sheet metal, in order to provide sufficient lateral strength to the base and platform. It should be appreciated that the side walls appearing in FIG. 15 can be formed on any of the other embodiments shown in the other Figures.

The sealed gas cylinder 71 consists of a cylinder proper 72 with a piston rod 73 sliding in and out through an aperture in one end of the proper 72. The piston itself is contained within the cylinder proper, with the piston rod being generally hollow, there being a number of internal passage ways within the cylinder proper 72 and the piston 73. These internal passage ways are used to control the flow of oil and gas, and thereby control the static and dynamic characteristics of the cylinder 71. While these sealed gas cylinders are well developed and know in the art, the use of these cylinders with the other elements of the scissors lift is what distinguishes the present invention over prior art lift devices.

The end of the piston rod 73 includes an eyelet 75 which is pivotally secured to the base flooring 52 by means of the floor mounted boss 57. Similarly, the end of the cylinder proper 72 is formed with another eyelet 74 which is pivotally secured to the bridge structure 41 by the lugs 44. Fasteners such as nut and bolt assemblies or rivet are used to connect these components together.

Figure 2:
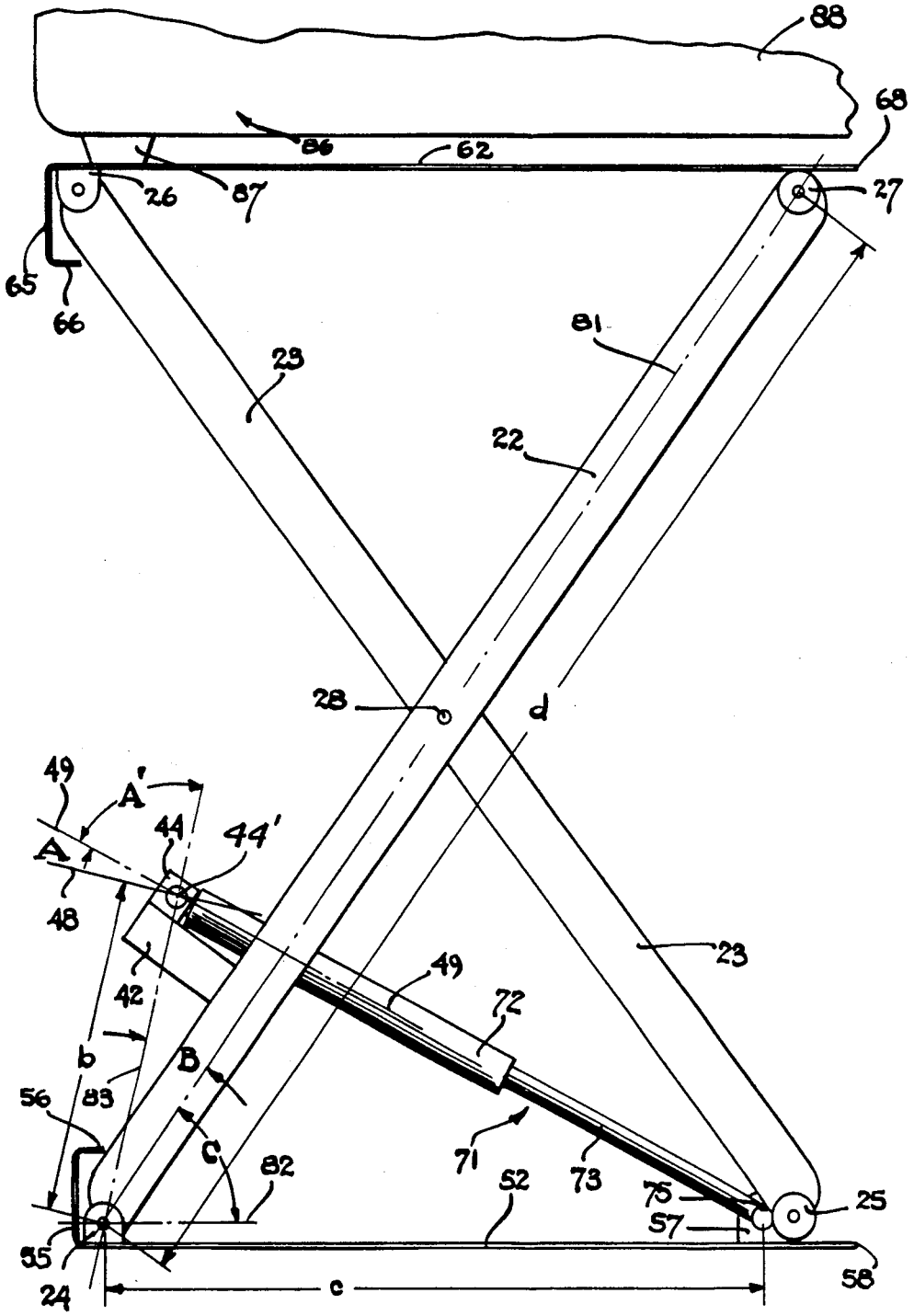
FIG. 2 is a side elevation of the same embodiment, also showing the lift apparatus extended (or "unfolded" or "raised"), and indicating the definitions of certain algebraic quantities used in analyzing the behavior of the invention.
Figure 3:
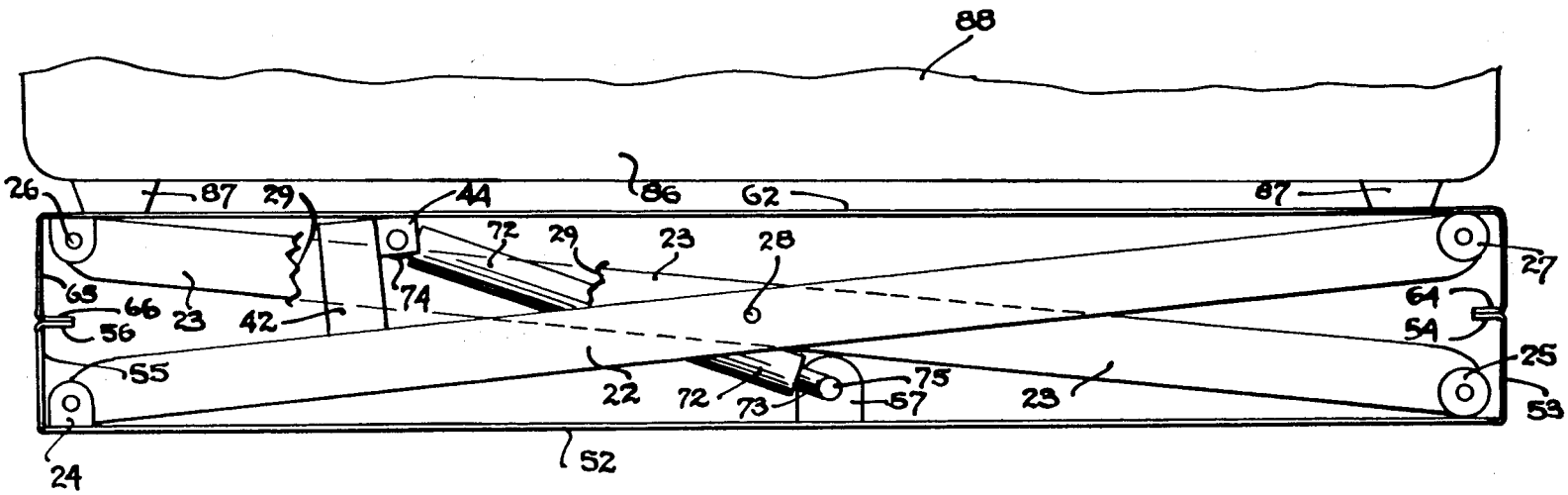
FIG. 3 is a similar view of the same embodiment, but showing the lift apparatus retracted (or "folded" or "collapsed"). One leg of the scissors is shown partly broken away for a clearer view of the mechanism behind it; and for the sake of clarity in that same area the corresponding leg at the rearward side of the lift is not illustrated.

Most of the components just identified appear in FIGS. 2 and 3 as well as FIG. 1. Also defined in FIG. 2, however, are some parameters of the energy-recycling scissors lift which are useful in analyzing the behavior of the system. In particular, the line of pivot centers 81 in the driven leg 22 makes an angle C with a horizontal line 82 (that is, the line 82 that passes through the center of the lower pivot of the driven leg 22 and that is parallel to the base flooring 52). The line of pivot centers 81 makes another angle B with a line 83 that connects the center of the lower pivot of the driven leg 22 with the center of the forcing-point pivot. Angle C may be conveniently called the scissors angle and angle B, the forcing-point offset angle. Both these angles are to be considered positive as illustrated.

The centerline 49 of the gas cylinder 71 also intersects the above-mentioned line 83—which connects the driven-leg pivot with the forcing-point pivot—in an angle A'. The complement A of this angle A' defines what might be called the error angle between the line 49 of force application by the gas cylinder 71 and the tangent line 48 of the arc which the forcing point 44' makes about the lower pivot of the leg 22. The mechanical advantage of this *portion* of the lift is best when this angle A is zero—that is, when force is applied along the tangent line 48—and it decreases as the platform moves to either side of that optimum position. For the purposes of the present discussion the error angle A will be considered positive when the scissors is fully retracted, and for small angles of extension; consequently it is negative after the platform has passed through the optimum position, as it has in the illustrated condition.

Also defined in FIG. 2 is the baseline c, which is the horizontal distance between the lower pivot of the driven leg 22 and the piston rod pivot 75; and the forcing-point radius b, which is the distance along the previously mentioned line 83 that joins the forcing-point pivot and the lower pivot of the driven leg 22. Moreover, the drawing also illustrates the leg length d, which is the distance between the centers of the two end pivots of the driven leg 22; in principle the interpivot lengths of the other three legs 23, 32 and 33 should be the same as this length d.

At the outset it should be noted that the best compensation or equalization results from large values of mechanical advantage at small scissors angles C. Large mechanical-advantage values in turn are produced by using a relatively large forcing-point offset angle B and/or a relatively large forcing-point radius b.

The offset angle B and radius b are usually chosen as values which yield reasonable mechanical-advantage equalization. According to the present invention it has been found to be a particularly advantageous compromise to make the offset radius around a quarter of the leg length d, and the offset angle B around twenty to twenty-five degrees. Although these parameters were chosen essentially by a process of educated trial and error, the general effects may be seen from an algebraic analysis of the apparatus.

The mechanical advantage which the lift gives the gas cylinder, against the vertically acting weight of the platform 62 and its payweight 86, is:

$$\frac{b \cos A}{d \cos C} = \frac{b \cos \left[ \tan^{-1} \frac{\cos (B + C) - b/c}{\sin (B + C)} \right]}{d \cos C}$$

Figure 4:
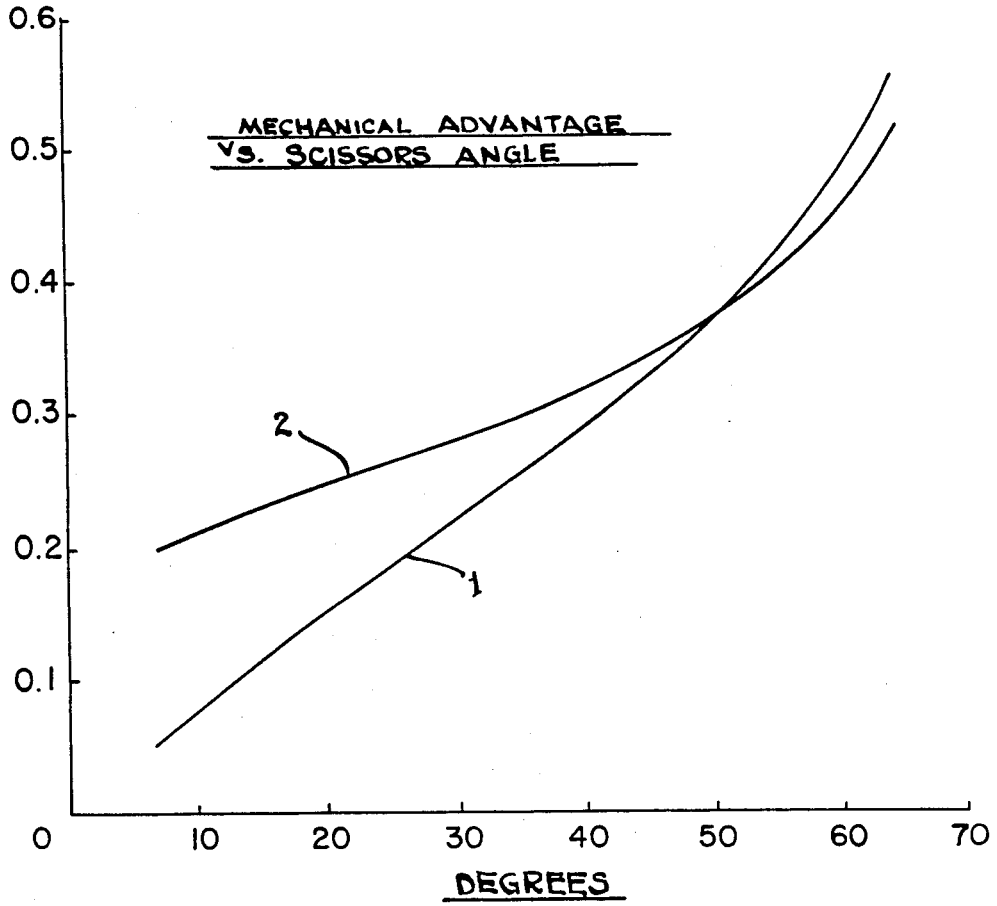
FIG. 4 is a graph showing the mechanical advantage which the gas sealed cylinder of FIGS. 1 through 3 has on a weight placed on the platform for a certain configuration—that is to say, for a certain combination of dimensions that is described in the text. The graph shows calculated mechanical advantage as a function of scissors angle.

If the leg length d is chosen as 29.75 inches, the base length c as 15.625 inches, and the forcing-point radius b as 7.25 inches (or the ratios between these three values are preserved while the absolute values are increased or decreased), the effect of varying the forcing-point offset angle B can be seen from FIG. 4. In this graph, curve 1 shows the calculated variation of mechanical advantage (dimensionless) with scissors angle C (in degrees) for a forcing-point offset angle of *zero*. In other words, this curve results from assuming the forcing point to be *along* the line of pivot centers 81 in FIG. 2.

The most salient features of curve 1 in FIG. 4 are its steepness and the very large range of mechanical-advantage values which it spans—from 0.06 at scissors angle of seven degrees to 0.56 at sixty-four degrees, a dynamic range of more than nine. That is to say, the mechanical advantage changes by a factor exceeding nine, over the operating range of such an apparatus.

The operating range here has been defined as seven to sixty-four degrees because the resulting range of platform heights (using the dimensions mentioned earlier) is satisfactory for a wide variety of cabinetry lift applications—though there is always a desire to provide even greater platform stroke, and thereby to encompass even other applications.

Now suppose that a gas cylinder is selected—or that a permanent gas charge for such a cylinder is selected—so that the force at the piston is just large enough to generally bear the combined weight of the platform and an article upon it when the scissors angle is seven degrees. This means that 0.06 times the piston force approximately equals the combined weight of platform and payweight. Another way of saying this is that the piston force must be chosen to equal the combined weight divided by 0.06. If the force at the piston were *unchanging* with cylinder extension—and consequently unchanging with scissors angle—then the upward force on the platform at sixty-four degrees would be 0.56 times the same piston force. Combining the last two statements, the upward force on the platform at sixty-four degrees scissors angle would be:

$$\frac{0.56}{0.06} \times \text{(combined payweight and platform weight)}$$

or

-continued $$9.3 \times \text{(combined weight)}.$$

Now if the combined weight equals, say fifty pounds, then the upward force on the platform at the extended position of the scissors (sixty-four degrees here) would be some 465 pounds. Allowing for the downward force due to the weights the net or excess upward force on the platform—the "overforce," in short—would be around 415 pounds. Few human beings alive would be able (without some added source of weight or other force, or some separate provision for leverage) to push the lift down from the sixty-four-degree position.

Practical payweights range to 150 pounds and more. Such payweights would entail extremely high platform forces at the extended position, up to 1400 pounds (with "overforce" of 1250 pounds), and these would be even more impossible for a user to lower. The essence of the equalization problem discussed earlier should now be clear.

Curve 2 in FIG. 4 shows the behavior of the mechanical advantage if the forcing-point offset angle B (FIG. 2) is made about twenty-five degrees. (The actual value used in the calculations was 24.7 degrees.) This curve is much flatter than curve 1; it ranges only from 0.2 to 0.52 a dynamic range of about 2.6 (instead of 9.3). Consequently if the gas cylinder (or its charge) were selected to bear the combined platform weight and payweight at scissors angle of seven degrees, the upward platform force at sixty-four degrees would be only:

$$\frac{0.52}{0.20} \times \text{(combined weight)}$$

or $$2.6 \times \text{(combined weight)}.$$

Now it can be seen that for a fifty-pound combined weight, the upward force is only about 130 pounds (instead of 480), and the "overforce" is only about eighty pounds (instead of 430). Accordingly it is nearly within the realm of practicality for many users to lower the lift from its extended position. The equalization problem has at least been seriously reduced, or partially solved. For larger combined weights the problem remains quite serious, since a cylinder suitable for a 150-pound combined weight would generate an "overforce" of 240 pounds, which is really impractical for most housewives and most office workers to lower.

The equalization problem can be reduced or solved by selecting the proper gas cylinder which will produce only a relatively small "over force" for a given payweight on the platform. Another way of solving the equalization problem is to change the forcing point offset angle B or radius b to compensate for the "over force." Practically speaking, however, it is sometimes difficult to obtain and select a gas sealed cylinder which will only produce a slight "over force" for a given payweight. For that reason, it may be more practical to utilize a compensating means which changes the respected offset point angle B or radius b in order to compensate for the "over force" created by the cylinder.

Figure 15:
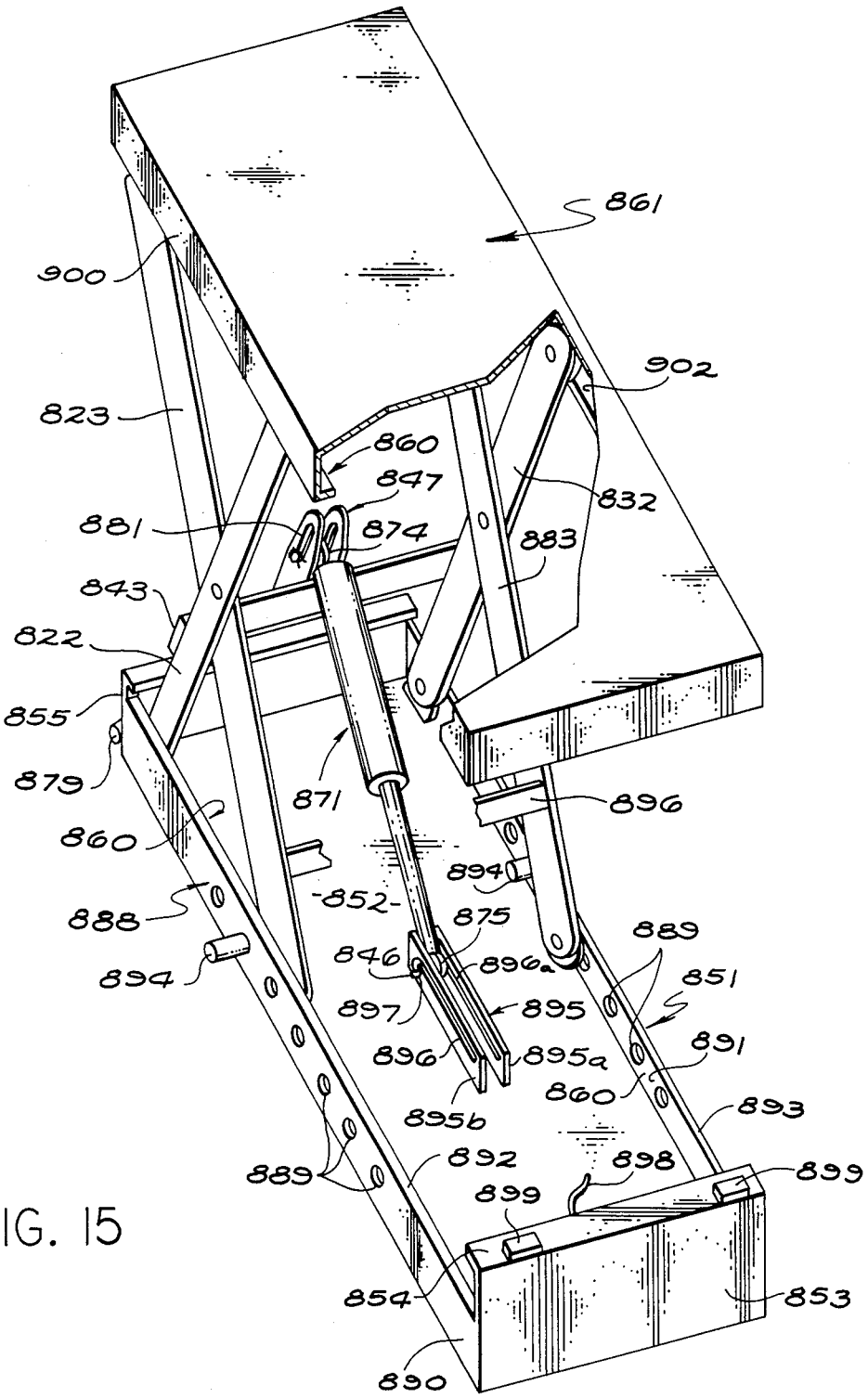
FIG. 15 is an isometric view of an embodiment of the present energy-recycling scissors lift incorporating the weight adjustment mechanism. The lift is shown extended, and its upper platform is drawn partially broken away for a clearer view of the mechanism.

One such mechanism which compensates for the "overforce" is shown in FIG. 15. In this embodiment, the scissors lift includes an overforce compensating means shown as a weight adjustment mechanism 847 which is attached to the bridge structure 843 of the lift apparatus. The embodiment shown in FIG. 15 is substantially similar to the embodiment of FIG. 1 except for the added features which will be herein described. For that reason, it will be unnecessary to identify the similar elements contained in the two embodiments.

Referring specifically to FIG. 15, the embodiment of the present scissors lift invention is shown having a weight adjustment mechanism 847 which includes means for adjusting the radius b to compensate for and dissipate a good amount of "overforce" imparted by the sealed gas cylinder 871. The weight adjustment mechanism is placed on the bridge structure so that the radius b can be increased or decreased depending upon the characteristics of the gas cylinder 871 and the payweight placed on the platform. The weight adjustment mechanism also varies the forcing-offset angle B to some extent but such a change is so slight and insignificant in relation to the change of the radius b that it will be assumed that the forcing-offset angle B remains constant. However, it should be appreciated that it is possible to utilize the weight adjustment mechanism in such a mannner so as to substantially change angle B along with radius b.

Figure 16:
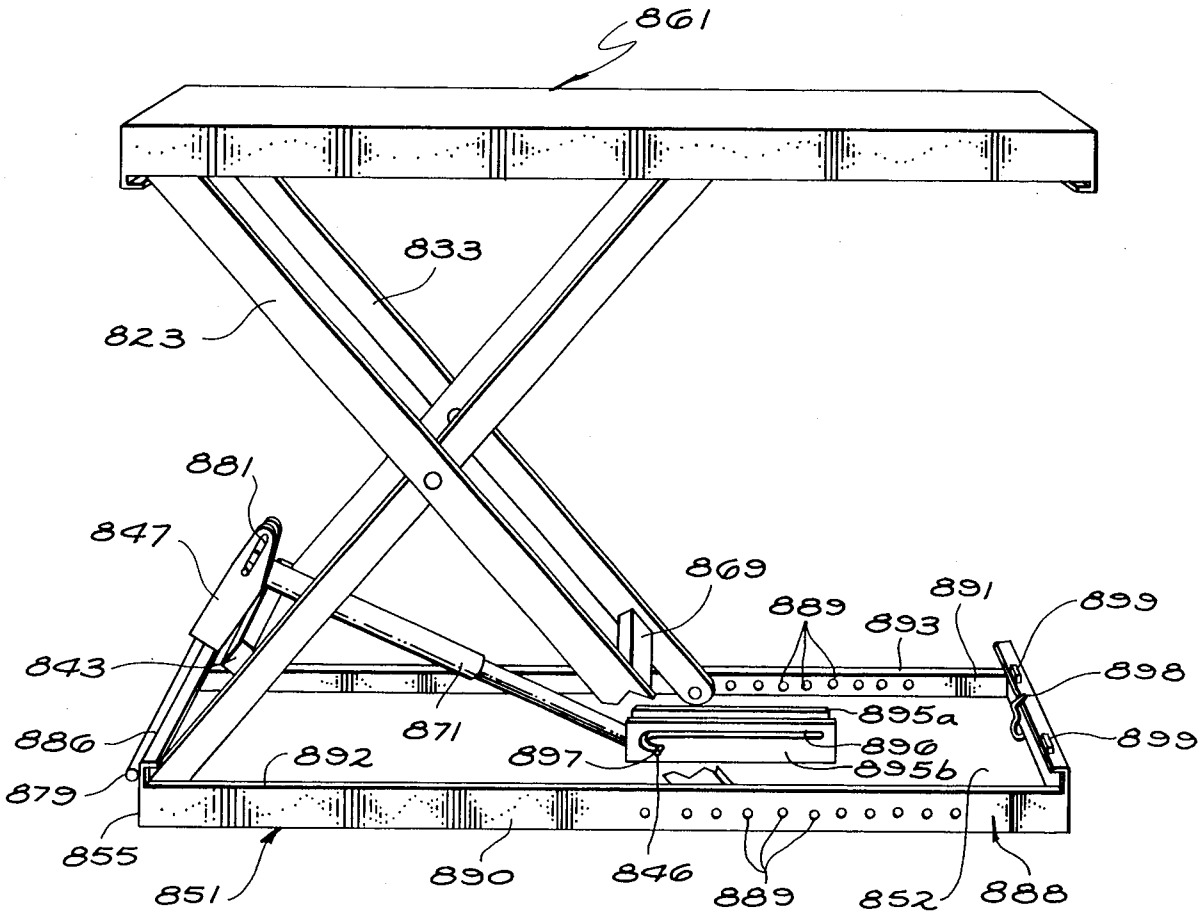
FIG. 16 is a partial, fragmentary side elevation view of the embodiment of FIG. 15 showing the lift extended (or "unfolded" or "raised").

The weight adjustment mechanism shown in FIGS. 15 and 16 is affixed to the bridge structure 843 and attached to one end 874 of the sealed gas cylinder 871. A second bridge bar 869 can also be placed on the first scissors legs 823 and 833 to futher stabilize the unit. FIG. 15 shows a partial fragmentary view of such a bridge bar 869. When an object is placed upon the platform of the lift apparatus, the weight adjustment mechanism is used to change the position of the end of the gas sealed cylinder to produce what would only be considered a slight "over force" on the lift at the extended position; a force which would be practical for most housewives and most office workers to overcome when it is desired to lower the platform. This is accomplished by changing the radius b by moving the end of the gas cylinder an appropriate amount along a slot 881 located in the weight adjustment mechanism. Generally, this slot 881 is about one and one-half inches long to permits the radius b to be changed during usage. The selection of the slot length and position is important since a slot which is too low will require considerable force by the user to move the platform into its retracted or extended position. A slot which is too high will not properly compensate for the "overforce" produced by the cylinder. Further, the slot must be short enough so that the height of the platform does not change dramatically. By enabling the manufacturer of a cabinet into which the lift apparatus is placed to adjust the "over force" caused by the cylinder, greater control of the scissors apparatus can be achieved since the manufacturer can "fine tune" the radius b as a function of the item being supported.

Figure 18:
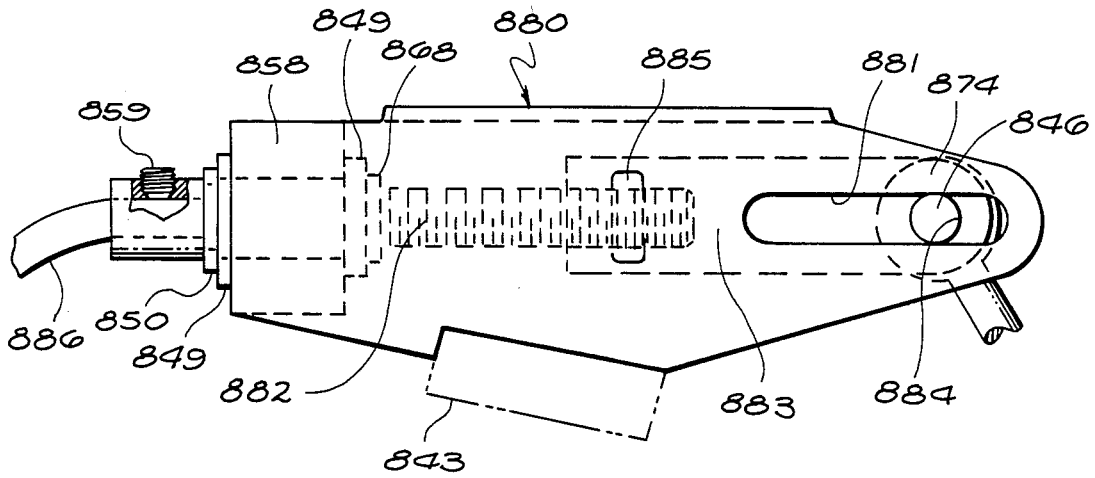
FIG. 18 is a side view of the weight adjustment mechanism of FIG. 15.
Figure 19:
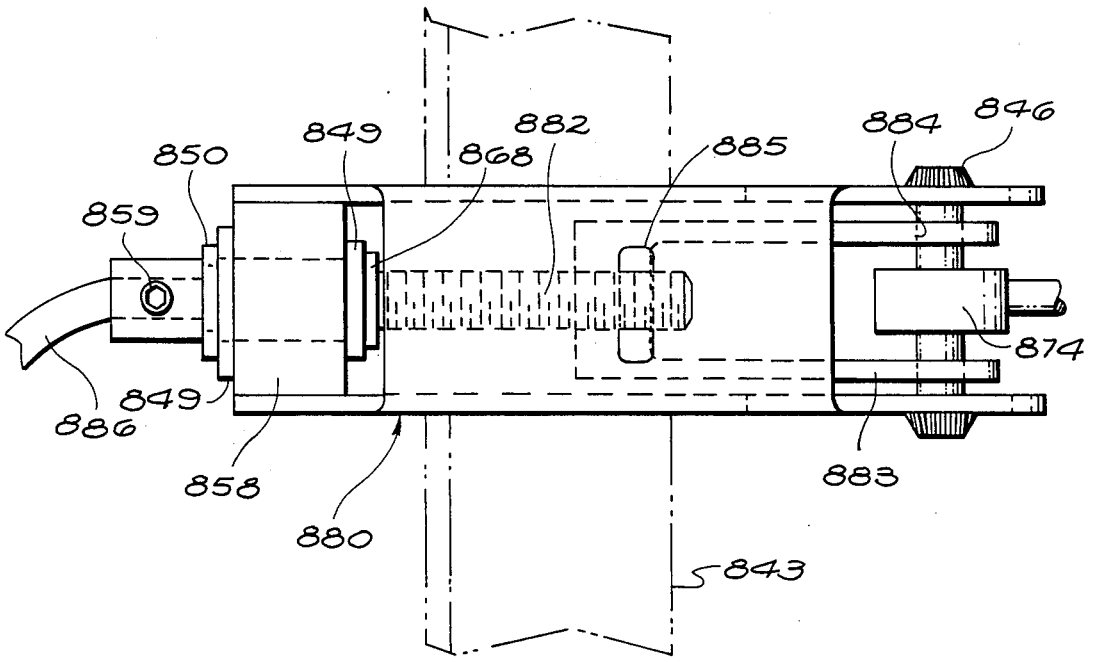
FIG. 19 is a top view of the weight adjustment mechanism of FIG. 18.

The weight adjustment mechanism is shown in greater detail in FIGS. 18 and 19. FIG. 18 shows a side view of the weight adjustment mechanism which includes a housing assembly 880, a slot 881 and a jack screw 882 arranged to move a clevis 883 which holds the end of the sealed gas cylinder. The jack screw 882 can be turned within the housing assembly 880 to permit the clevis 883 to move along the slot 881 on the housing in order to move the end of the sealed gas cylinder. The clevis has a bore 884 (FIG. 18) which receives a pin, rivet 846 or other suitable fastener which is placed through the eyelet 874 of the cylinder. A better view of the clevis and jack screw are shown in FIG. 19 which is the top view of the mechanism. The clevis has a nut 885 welded or suitably fastened to it to permit the clevis to move along the jack screw to move the rivet 846 relative to the slot 881. A flexible shaft 886 is also included and is attached to the jack screw by a set screw 859 to permit one to rotate the jack screw more easily. The flexible shaft 886 can be extended down to a convenient location such as through a sleeve 879 where it can be easily turned by the user. As can be seen, the sleeve is welded to an end piece 855 of the base 851.

The jack screw is generally rotatably fixed to the housing assembly by placing the screw through a solid block 858 which makes up part of the housing. A flange 868 on the screw and an E-clip 850 hold the shaft of the screw to the block. Vinyl washers 849 or other suitable washers can be placed between the block and E-clip 850 and flange 868 to permit the screw to turn freely. It should be appreciated that any other structure can be used to move the clevis within housing, however, the assembly disclosed herein is advantageous due to its simplicity and low cost to manufacture.

The embodiment shown in FIGS. 15 through 19 also includes advantageous features which can be used with any of the other embodiments shown and described herein. Referring to FIGS. 15 and 16, a platform height adjustment structure 888 is provided to adjust the height of the platform for any given application. The platform height adjustment structure permits the platform to extend to a number of different heights while in use. The platform height adjustment structure 888 is shown as a plurality of bores 889 which are located in sidewalls 890 and 891 which extend along the base 851 of the lift. The side walls 890 and 891 can further include horizontal pieces 892 and 893 which are bent on the sheet metal to define channels 860 for the wheels to roll in. The bores 889 are placed at various locations along the sidewalls 890 and 891 so that the height of the platform can be adjusted to a number of different settings. A pin 894 or any other suitable stopper means is placed within one of the bores 889 to engage the wheels or scissors leg and to prevent the first scissors legs 823 and 833 from moving any further along the base. Therefore, once the scissors legs 823 and 833 are stopped along the sidewalls 890 and 891, they can proceed no further and thus prevent the platform from extending any higher. The pin 894 can be placed in any of the bores along the sidewalls so as to obtain the desired height for the platform. While it is generally prefereable to place the bores in the sidewalls 890 and 891 of the base 851, similar bores could be placed in the sidewalls 900 and 902 on the platform to prevent the second scissors legs 822 and 832 from translating along the platform.

The second advantageous feature shown on the embodiment in FIGS. 15 though 17 includes a shipping boss 895 which is used when the scissors lift is shipped in package or box. The shipping boss 895 permits the unit to be collapsed even further than the fully retracted position and generally reduces or eliminates the force produced by the gas sealed cylinder until the unit is ready for use. This feature is important since the force imparted by the cylinder is much greater when there is no payload on the platform which is typical when the unit is being shipped to a customer.

Figure 17:
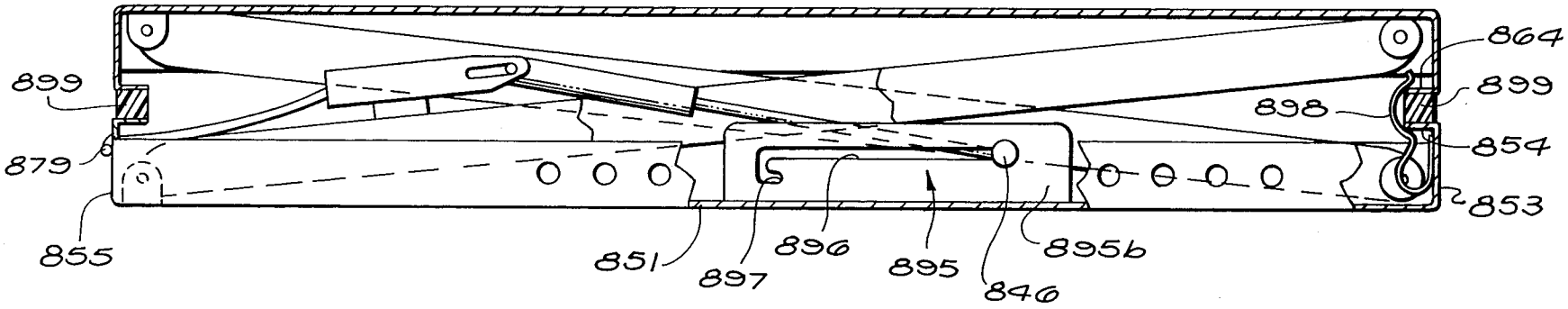
FIG. 17 is a similar side elevation of the embodiment of FIG. 15 but showing the lift retracted (or "unfolded" or "collapsed").

The shipping boss 895 extend along the base floor section 852, and consists of two plates, **895*a* and 895*b* each plate having a "J" shaped slot 896 and 896*a*. The slots extend from one end of the plates to the other end and down through a vertical position where it forms a notch 897. The notch is used to retain the pin 846 which holds the piston rod pivot eyelet 875 to the boss. FIG. 17 shows how the piston rod pivot eyelet is initially located in the upper part of the "J" shaped slot 896 during shipping and FIGS. 15 and 16 show it in its later position within the notch 897** where it remains permanently during usage.

Referring again to FIG. 17, the shipping boss 895 is shown in use when the scissors lift is in a totally collapsed position ready to be shipped from the factory. Initally the pin 846 holding the piston rod eyelet is placed in the upper portion of the slot 896 to enable the platform and base to collapse to a position which is closer than the retracted position found during normal use. After the user receives his scissors lift, he merely lifts up on the platform, whereby the end of the piston rod travels along the "J" shaped slot toward the notch 897 where it remains permanently during usage. Once the end of the piston rod travels from its shipping position to the normal usage position, the pin 846 remains there and is incapable of moving back to the initial shipping position unless the end of the piston rod is disconnected and moved by hand.

Another advantageous feature of the embodiment shown in FIGS. 15 to 19 is a mechanical latch 898 (see FIG. 17) which is connected to an end piece 853 and which is used to maintain the base and platform closed when the apparatus is placed in its retracted position. Rubber stoppers 899 are placed either on the short horizontal sections 854 or 864 of the base or platform in order to maintain the base and platform at a fixed distance from each other when in the closed mode. The latch is long enough to engage and hold the horizontal sections of the platform and base as is shown in FIG. 17. This latch 898 is basically used when the sealed gas cylinder produces an overforce on the platform in the retracted position since the platform would otherwise start up on its own from this position. The latch prevents the platform from moving upwardly, thus insuring that the scissors lift will remain in the retracted position during shipping. Usually, a small upward force is required to release the platform from the latch. This starts the platform moving upwardly to its extended position. Once the latch is released, the platform rises smoothly and quietly. To retract the platform, a downward force is applied until the latch is engaged. A similar latch may be placed on the opposite side of the base if it is desired. Similarly rubber stoppers 899 may also be placed on the other upright end piece 855 as shown in FIG. 17.

Figure 5:
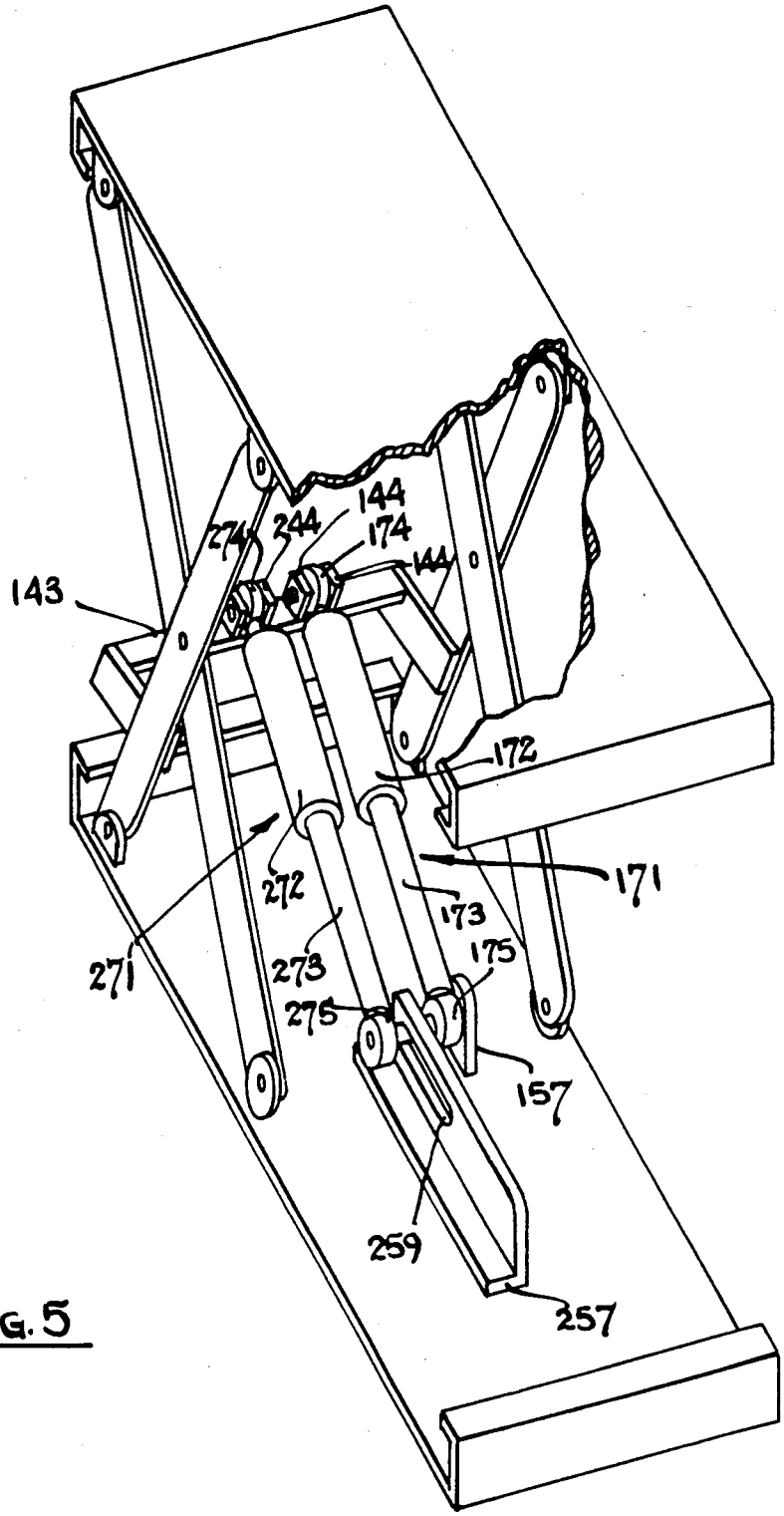
FIG. 5 is an isometric view (similar to that of FIG. 1) of another embodiment of my invention, which incorporates an equalizing or compensating gas cylinder in addition to the primary cylinder of FIGS. 1 through 3

The present invention encompasses several other ways of dealing with the overforce problem. FIG. 5 shows another embodiment of the invention, which offers one such way. Most of the components are just the same as in FIGS. 1 through 3 and will not be described again here. The gas cylinder 71 of those earlier drawings is essentially the same as cylinder 171 in FIG. 5, except that it is moved to the side to make room for a second cylinder 271.

This second cylinder is an equalizing or compensating cylinder, which is arranged to add lifting force only at small scissors angles—so that the total platform force at small angles (that is, in and near the retracted position) can be generally equal to the total platform force at large angles (that is, in and near the extended position). The equalizing cylinder 271 has a cylinder section proper 272 generally similar to the corresponding cylinder proper 172 of the primary cylinder 171 (and to the corresponding cylinder proper 72 of FIGS. 1 through 3). The equalizing cylinder 271 also has a piston-rod section 273 that is generally similar to the corresponding feature 173 of the primary cylinder 171.

The equalizing cylinder proper 272 has an eyelet 274 (like the eyelet 174 of the primary cylinder), which is attached to the bridge structure 143 by lugs 244 that are similar to (and next to) the lugs 144 for the primary cylinder. Thus the two cylinders drive the bridge, and thereby the scissors, in parallel.

The equalizing-cylinder's piston-rod pivot or eyelet 275, however, is *not* pivotally mounted to a fixed boss as is the corresponding structure 175 of the primary cylinder 171. Rather the pivot or eye 275 is mounted for sliding motion, as well as rotation, to a slotted angle iron 257 or the like. The pivot 275 engages the remote end-wall of the slot 259—that is, the end of the slot that is forward and to the right in FIG. 5, remote from the bridge structure 143—when the scissors lift is in or near the fully retracted position. When the scissors lift is retracted or nearly so, the piston and piston rod 273 of the equalizing cylinder 271 are accordingly driven at least partway into the cylinder proper 272, producing a force which tends to extend the scissors lift.

After the scissors has extended by some predetermined amount, however, the equalizing-cylinder piston rod 273 will have moved by its entire travel outwardly from the cylinder proper 272. Further motion is precluded by internal abutment of the piston within the cylinder proper 272, against the end-wall of the the cylinder proper 272. Accordingly no further force is generated as between the bridge and the slotted angle 257; to avoid the stopping of the lift by the out-of-travel equalizing cylinder 271, the slot 259 permits the piston pivot 275 to move toward the lower pivot axis of the driven legs. In this part of the motion the equalizing cylinder is passive. For purposes of expressing this embodiment of the invention in a general way, the aforesaid remote end-wall of the slot 259 that is engaged by the sliding pivot or eye 275 may be called "a stop"; the fixed boss 157 in its interaction with the piston-rod pivot or eyelet 175 of the primary cylinder 171 may be called "a pivotal-attachment boss"; and the slot 259 in its interaction with the sliding pivot or eye 275 may be called "release and guide means".

The terminology "release and guide means" is chosen to connote that when the platform is *rising*, the slot 259 functions to "release" the remote sliding-pivot end 275 of the second cylinder 271 to move away from the stop (after movement of the platform upwardly through a predetermined distance); and when the platform is *descending*, the slot 259 functions to "guide" the remote sliding-pivot end 275 back to the stop.

As an example, if the payweight combined with the platform weight is 150 pounds, the primary cylinder or its gas charge may now be selected to exert 150 pounds upward force near the upper end of curve 2 in FIG. 4—at, say, a scissors angle of fifty-five degrees, where the mechanical advantage is about 0.41. When the scissors angle reaches sixty-four degrees, where the mechanical advantage is about 0.52, the total upward force will be only:

$$\frac{0.52}{0.41} \times \text{(combined weight)}$$

or

-continued $$1.27 \times \text{(combined weight)};$$

$$= 190 \text{ pounds};$$

Here the overforce will be just forty pounds, which most users will be able to counteract (for the purpose of lowering the lift) by applying some of the user's body weight to the platform—that is, simply by leaning on it. The primary cylinder 171 will be unable to bear the combined weight at any scissors angle below fifty-five degrees, but the equalizing cylinder 271 will supply the difference in any one of several ways.

For example, at the bottom of the action the primary cylinder will supply only 0.2/0.41 times the necessary combined weight—that is to say, about half. The equalizing cylinder could be made to supply the other half. Since the baseline (the equivalent of the parameter c in FIG. 2) for the equalizing cylinder is much longer than the baseline for the primary cylinder, the former cylinder will follow a somewhat different curve, and will run out of travel at some scissors angle between, say twenty and fifty-five degrees.

A great variety of different behaviors can be provided, depending upon the choice of baseline, cylinder force and extension, and so on. If the equalizing cylinder is made to run out of travel at fifty-five degrees or more (continuing the previous discussion of curve 2), then the equalizing cylinder will in effect "hand off" the combined weight to the primary cylinder at a point where the latter can generally bear the weight. This is *not* necessary, however; rather, the operation of the equalizing cylinder can be made to run out of travel at rather low scissors angles, such as twenty or even fifteen degrees. If the force applied during those initial twenty or fifteen degrees is great enough, and the speed at which the equalizing cylinder extends itself is great enough, the payweight and platform weight can be made to accumulate upward *momentum* sufficient to carry them through the "deficit"-upward-force region to the fifty-five-degree point. In effect, the equalizing cylinder only equalizes the top and bottom of the operating range, leaving the platform to "coast upward" through the intermediate regions. From the earlier discussion of FIG. 5 it will be clear that the point at which the equalizing cylinder is made to "run out of travel" is controlled by the location of the remote end of the slot 259 (FIG. 5), in relation to the equalizing-cylinder stroke and piston-rod length, and in relation to the locus of the scissors forcing point.

In one generally satisfactory prototype that has been constructed, the remote end-wall of the track or slot 259 (FIG. 5) is approximately 22.1 inches from the lower pivot point of the driven scissors leg 22, and the slot 259 itself is approximately 7.4 inches long. Thus the effective base length for the equalizing cylinder 271 is 22.1 inches, and the equalizing-cylinder's piston-rod pivot or eyelet 275 has 7.4 inches of "free" travel along the slot 259 after running out of working travel. This particular unit operated by the "hand-off" approach mentioned in the preceding paragraph.

In any event, the important consideration is to bring the upward platform forces at the two ends of the operating range within a small permissible discrepancy, so that the lift essentially bears the combined weight at both ends of the range, leaving the direction of motion at both ends to be controlled by mere pilot forces. As previously mentioned, in one embodiment of the invention the lift may be made to *slightly more* than bear the combined weight—so that the user must press downward slightly to lower the payweight, and engage a catch at the bottom of the action to hold the payweight down, whereas it rises unaided when the catch is released.

In another embodiment of the invention, the lift may be made to *not quite* bear the combined weight—so that the user must pull upward slightly to raise the payweight (from the bottom of the action), and engage a catch at the top of the action to hold the payweight up, whereas it descends unaided when the catch is released.

In yet another embodiment, the lift may be made to *either* slightly more than bear the combined weight or not quite bear the combined weight, with the necessary upward and downward direction-controlling pilot forces supplied by a small motor and screw drive (or worm and worm gear), or a small hydraulic or pneumatic cylinder. If desired, any of these devices can be made to supply the necessary retaining forces when not activated, to obviate the need for a separate mechanical catch. The pilot-force device in effect provides remote control—though it need not be any more "remote" than a switch on the console or cabinet which houses the lift. If preferred the control switch can be on a nearby panel, or across a room (as in the case of a lift-mounted television set), or even in another room (as in the case of computer equipment or banking equipment that is to be secured against intruders or other unauthorized access). Accordingly the phrase "controlled remotely" is hereby defined, for the purposes of the appended claims, as encompassing a control device that is mounted to the lift-enclosing cabinet, as well as a control device that is mounted more remotely from the lift mechanism.

Figure 13:
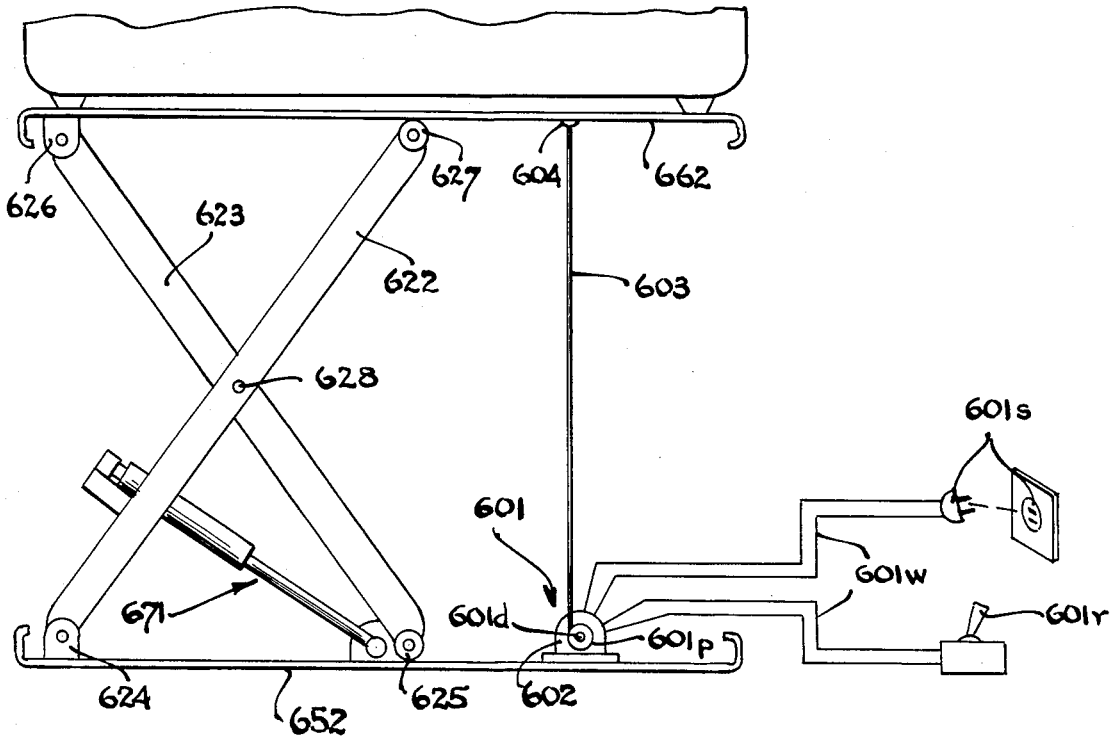
FIG. 13 is a side elevation of the embodiment of the invention in FIG. 1 which incorporates a small electric motor for supplying a pilot force.

FIG. 13 shows an embodiment of my invention that incorporates a small electric motor 601 for supply of pilot forces. Such a motor may be mechanically connected to the lift in a great variety of ways, since only small forces need by transmitted—the payweight being very nearly balanced by the upward force at the platform due to the energy-storage device. Consequently the illustrated mechanics (as well as the screw drive mentioned earlier) are to be understood as merely exemplary.

The electric motor 601 has a casing 602 that is secured to the base 652 of the lift. The motor also has a drive shaft **601*d*, on which is fixedly mounted a drum or pulley wheel 601*p*. A lightweight metal cable 603 is fixed near one end to the periphery of the drum or pulley wheel 601*p*, and near its other end to an attachment 604 on the underside of the lift platform 662. The motor also has power-supply wires 601*w*, by which it may be connected to a remote switch 601*r* and to a source 601*s*** of electrical power.

The switch **601*r* and wireing 601*w* are selected and arranged to permit a user to control the direction of the motor drive shaft 601*d* by manipulation of the remote switch 601*r*. This may be done in any one of a great variety of conventional ways, such as reversing the polarity of dc power supplied to a dc motor 601, or shifting the phase of ac power supplied to an ac motor 601**. Such arrangements can be made wireless by use of small radio transmitters like those used in changing television-station channels.

When the remote switch **601*r* is manipulated to operate the motor shaft 601*d* in the counterclockwise (as illustrated) direction, the cable 603 is wrapped around the pulley 601p, pulling the platform 662 downwardly. Limit switches (not shown) may be provided if desired, or the user may simply deactuate the motor by use of the remote control when the platform 662 has fully descended. Friction and inertia within the motor 601 suffice to hold the platform in its lowered position, against the upward force of the cylinder 671**.

To raise the platform the user manipulates the switch 601r to operate the drive shaft 601d clockwise, allowing the platform 662 to rise—pulling the end of the cable 603 upward with it, and unwinding the cable 603 from the drum or pulley wheel 601p. When the platform is fully raised, once again the motor 601 may be deactuated by operation of a limit switch or by the user's manipulation of the remote switch 601r.

Figure 14:
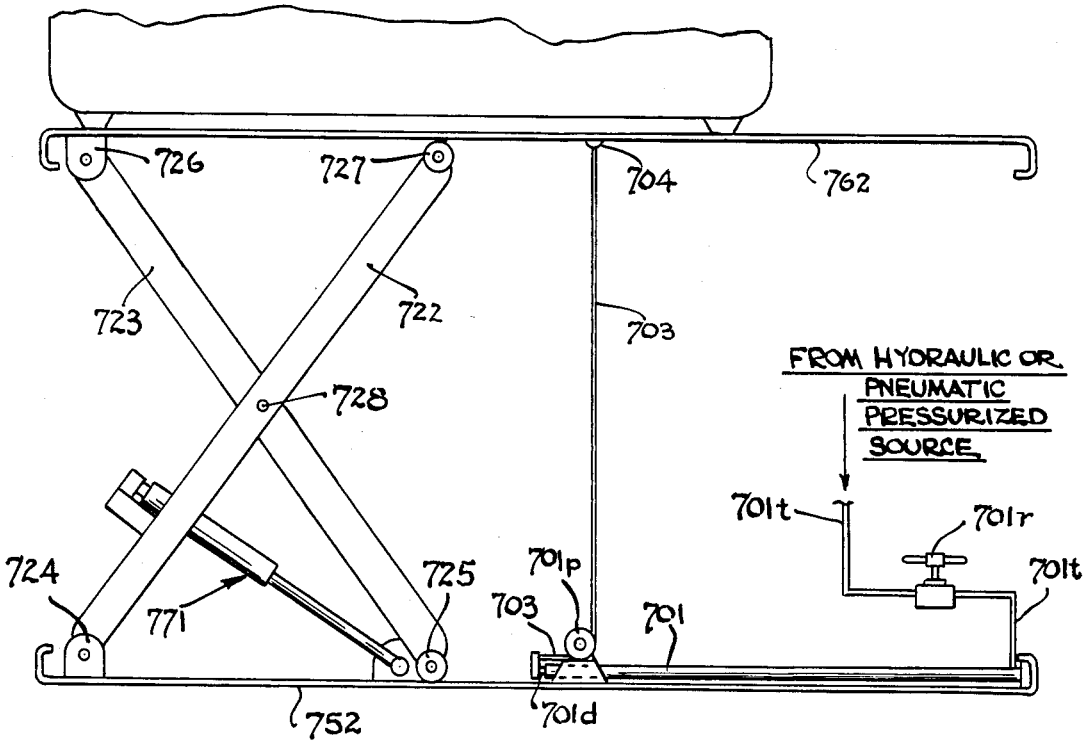
FIG. 14 is side elevation of the embodiment of the invention in FIG. 1 which incorporates a remote actuated pneumatic or hydraulic unit for supplying a pilot force.

In some installations electrical interconnections are hazardous or otherwise undesirable. For example, in some industrial facilities explosive atmospheres may be present. In some installations many other pieces of equipment are remote-actuated pneumatically or hydraulically, and pneumatic or hydraulic control tubing lines may already be in place. In such situations the electrical motor 601 may be replaced by a pneumatic or hydraulic cylinder 701 as illustrated in FIG. 14. The cylinder 701 has a drive rod 701d which pulls a cable 703 to lower the platform 762 as in FIG. 13.

Retractability of the platform 762 militates in favor of a horizontal disposition of the cylinder casing 702, but the resulting horizontal motion of the cylinder drive rod 701d is readily converted to vertical motion by passage of the cable 703 around one-fourth of a pulley wheel 701p. A manually operated remote valve 701r is connected by hydraulic or pneumatic tubing 701t to control the direction of the cylinder drive rod 701d. Operation is essentially the same as described for the electrical version in FIG. 13, with limit valves (not illustrated) being optionally usable in place of limit switches. Of course, it will be appreciated that the control means (electrical, pneumatic or hydaulic) can be placed on any of the other embodiments found in FIG. 6, 7, 12 and 15.

Figure 6:
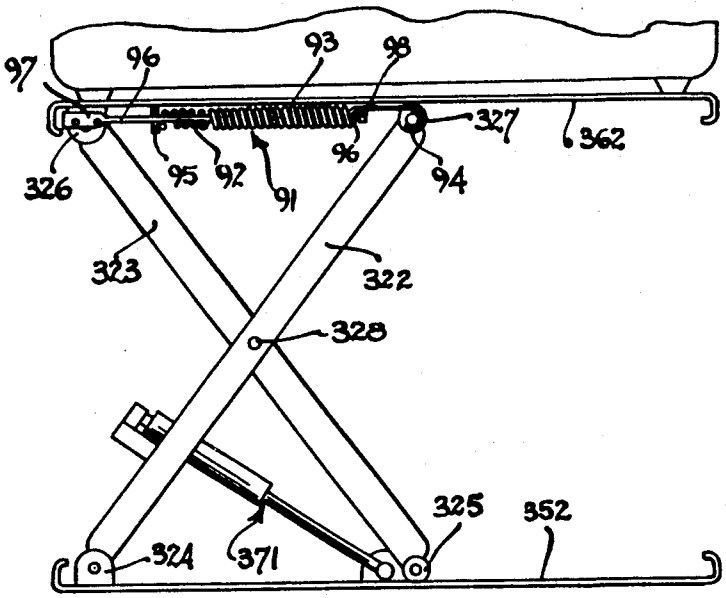
FIG. 6 is a side elevation (similar to that of FIG. 2) of yet another embodiment, which incorporates an equalizing or compensating spring in addition to the gas cylinder of FIGS. 1 through 3.

Another embodiment of the invention appears in FIG. 6. Here the equalizing cylinder 271 of FIG. 5 and weight adjustment mechanism of FIG. 15 is replaced by an equalizing spring 91. This spring is shown partly in cross-section in the area 92, for clarity of explanation. As shown one end of the spring leads to a hook 94 or like device for engaging the pivot pin at the center of the wheel 327, at the top of the driven leg 322. The other end of the spring 91 is welded, or otherwise suitably attached, to a washer or ring 95. Through the center of the spring 91, and through the center hole of the washer 95, is a rod 96; this rod is attached by a suitable bracket 97 to the boss 326 on the underside of the platform 362. The rod extends horizontally toward the wheel 327, and has a head or flange 98 which is too large to pass through the central hole in the washer 95.

As the scissors lift approaches the fully—or almost fully—retracted position, the wheel 327 moves progressively further from the boss 326. Accordingly the spring 91 is pulled to the right, along the rod 96, by the wheel 327, so that the washer 95 engages and is stopped by the flange 98. With further retraction, since the left end of the spring cannot move further rightward, the spring 91 is stretched—storing energy in extension of the spring.

By proper selection of the spring constant, spring length, and other parameters, the spring 91 can be made to supply equalizing or compensating force near the bottom end of the action sufficient to permit lowering the lift by application of pilot forces near the top end of the action. As will be plain in the light of the foregoing disclosure, various other ways of arranging springs to accomplish this task are possible. For example, springs can be arranged to push and be compressed, rather than to pull and be stretched. In most embodiments of the invention that use springs, the relatively steep force-versus-travel characteristic of springs will militate in favor of using the coasting upward approach mentioned earlier in connection with the equalizing gas-cylinder embodiment, rather than the "hand-off" approach.

Once again it must be emphasized that the objective here is to bring the raising force at the extended positions into rough equality with the raising force at the retracted positions, so that there is no excessive "overforce" at the extended positions—and not merely to supply sufficient force to raise the scissors lift from its retracted position. Gas cylinders, and relatively lightweight scissors mechanisms are readily available in configurations capable of lifting even 200- and 300-pound weights, and the problem of binding that is explored in the prior art is readily soluble by means considerably short of those employed in the present invention for equalizing purposes. In none of the embodiments of the present invention is the primary cylinder disconnected, or its forcing action reversed or diminished, as in all of the prior art.

Figure 7:
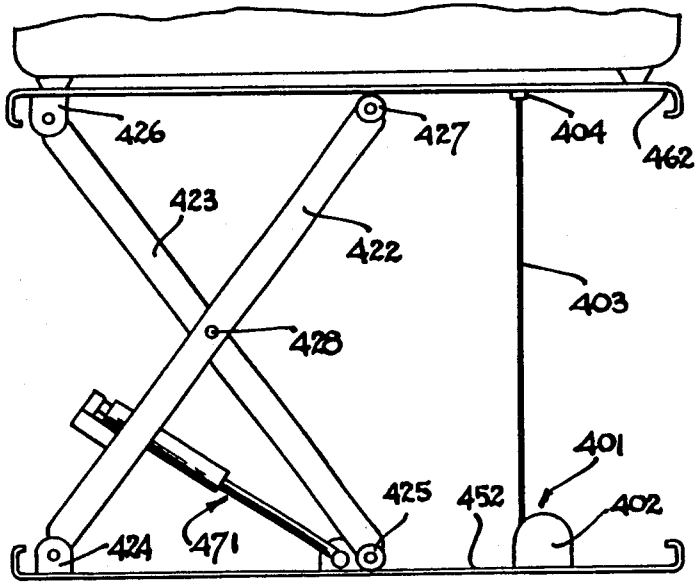
FIG. 7 is a side elevation (similar to that of FIGS. 2 and 6) of still another embodiment, which incorporates a different type of equalizing or compensating spring in addition to the gas cylinder of FIGS. 1 through 3.

Another embodiment of the present invention appears in FIG. 7. Here the equalizing function is performed by a spring reel 401, which acts in a different way than the embodiment of FIG. 6—although the general principles of the two embodiments are related. The spring reel has a case 402 in which a conventional mechanism allows travel of the tape 403 out of the case without mechanical resistance (or with very little resistance), but only for a certain specified distance. Once the tape 403 has moved out of the case 402 by that distance, an internal spring (not shown) comes into play and applies increasing force in opposition to the further outward motion of the tape. The reel case 402 is secured to the base flooring 452, and the remote end of the tape 403 by a fitting 404 to the platform 462—or vice versa, so that the internal spring, once it comes into play, opposes extension of the platform. The reel 402, tape 403, and fitting 404 are out of the plane of operation of the scissor legs and wheels, so that there is no interference with the retraction of the scissors lift.

The direction of action here—pulling the bottom and top of the scissors toward each other, rather than pulling the tops of two legs of the scissors toward each other—produces an oppositely directed motion from that of FIG. 6. The spring reel is used to oppose and cancel the large overforce at the top of the mechanical-advantage curve 2 of FIG. 4; this leaves the gas cylinder to only generally bear the weight of the platform, and of the article on the platform, as in the other embodiments already described. (It will be noted that a similar mechanism could be used between the boss 326 and wheel 327 of FIG. 6, in place of the spring 91 and guide/limit rod 96 there shown.)

Figure 8:
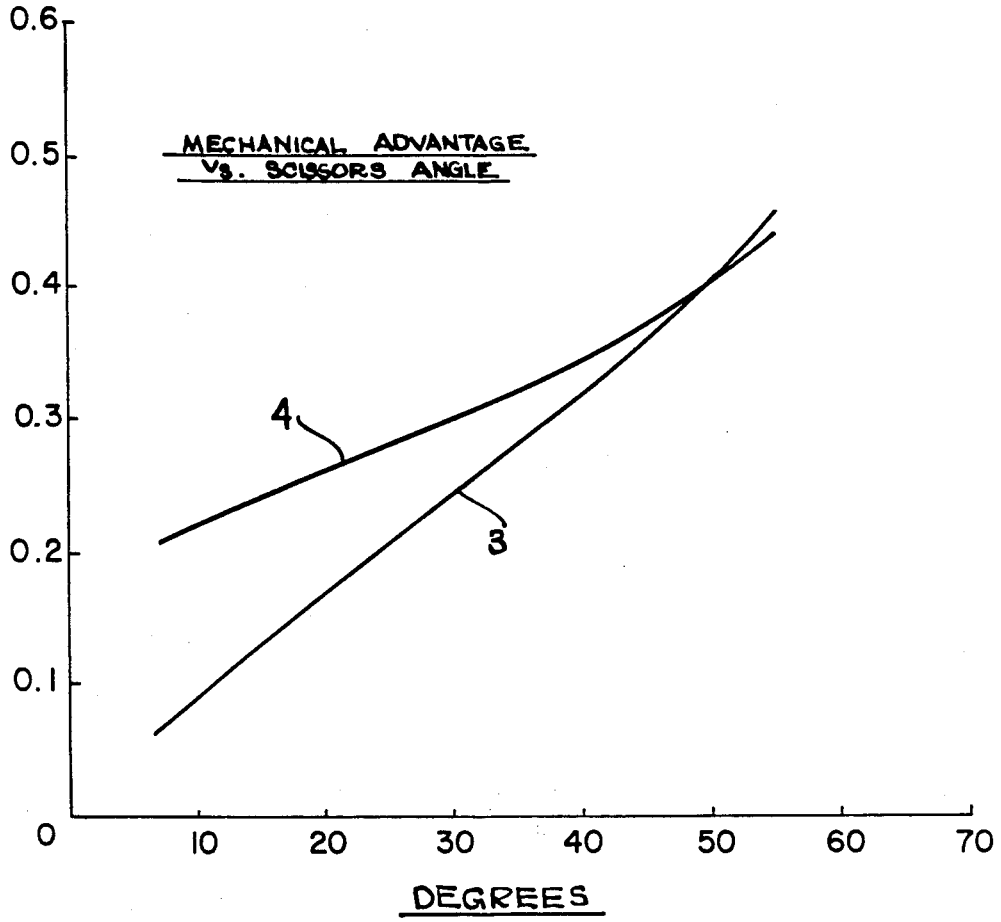
FIG. 8 is a graph (similar to that of FIG. 4) showing the calculated mechanical advantage which the gas cylinder of FIGS. 1 through 3 has on a weight placed on the platform.

Another approach to moderating the extreme variation of mechanical advantage of the scissors linkage is represented by FIG. 8. Curves 3 and 4 are analogous to curves 1 and 2, respectively, of FIG. 4—but there are two changes or groups of changes. First, the dimensions and their ratios have been changed slightly. The leg lengths, particularly the segments above the central pivots (such as 28 in FIGS. 1 through 3), are slightly increased. Secondly, the range of operation as to the scissors angle is decreased: the lift goes only to fifty-five degrees, rather than sixty-four degrees. Thirdly, the range of operation as to the platform height is slightly decreased. As a result of these various compromises, nearly the same platform stroke is obtained but the very steep uppermost part of the mechanical-advantage curve is cut off—that is, the lift is not used in that unfavorable region.

Consequently, even though curves 3 and 4 are very slightly steeper than curves 1 and 2, respectively, the overall variation of mechanical advantage is more acceptable. The total variation for curve 4 (FIG. 8), the preferred embodiment, is from 0.21 at seven degrees to 0.44 and fifty-five degrees; and the platform stroke is about 21.7 inches, reasonably comparable to that for curve 2 (FIG. 4). The dynamic range is now:

$$0.44/0.21=2.1,$$

which is lower than the 2.6 obtained previously for curve 2. Using these dimensions and operating range for the embodiments shown in FIGS. 5, 6 and 7 and already discussed, even smoother and easier operation can be obtained than with the dimensions and operating range assumed earlier.

The assumptions used in the calculations shown in FIG. 8 are that the leg length d is 31.125 inches, the base length c is 16.65 inches, and the forcing-point radius b is 8.123 inches. As before, the forcing-point radius b is roughly a quarter the leg length—rather than nearly half as in the closest prior art. The forcing-point offset angle B is zero in curve 3 (as in curve 1), and 22.2 degrees in curve 4.

The invention encompasses yet another area of innovation which produces operation far superior to that obtainable with any embodiment yet described. This area of innovation leads to another embodiment of the invention which causes the upward force on the platform to be rendered virtually constant—almost independent of scissors angle—over the entire operating range of the mechanism as defined by curve 4 (FIG. 8). This means that the overforce (if any) provided at the retracted position is very nearly the same as the overforce (if any) provided at the extended position (fifty-five degrees). Furthermore, this can be accomplished without providing a separate equalizing cylinder, spring, spring reel, or the like.

The key to this innovation resides in the known available variants or modifications of sealed gas cylinders, and particularly in the use of various amounts of oil for damping, and for provision of a cushioning effect in known applications such as office chairs, previously mentioned. By adding oil to gas cylinders a manufacturer changes not only the damping but also the cylinder volumes available for expansion of the gas, at various piston positions. By the classical gas laws, the addition of oil therefore changes the gas pressure at various piston positions—and in fact the *ratios* of gas pressures for respective various piston positions.

The result of changing the gas-pressure ratios corresponding to various piston positions is in turn to change the fractional force increment observed at zero piston extension relative to full piston extension. For instance, when there is no oil added the force-versus-travel characteristic of a gas cylinder can be made nearly flat (as in curve 5 of FIG. 9)—originally considered particularly desirable, since the force-versus-travel characteristic of springs is too steep.

By adding selected quantities of oil, however, the cylinder force at zero extension can be made—for example—1.84 times the force at full extension (curve 6 of FIG. 9), or can be made 2.07 times the force at full extension (curve 7 of FIG. 9), etc. It is not within the scope of this document to describe how this is to be done, and it is not necessary to offer such a description here since it is within the established manufacturing capabilities of a gas-cylinder manufacturer to provide cylinders in which the force function varies in the general way indicated and has an overall force variation to be specified by the buyer.

The idealized force-versus-travel characteristic of these cylinders, customized to the application at hand, is essentially a straight line when plotted against piston extension. When plotted against scissors angle as in FIG. 9, each characteristic curve appears as two very nearly straight segments connected by a rather abrupt inflection point, as can be seen by careful examination of each of curves 6 and 7.

Curves 6 and 7 are angled or slanted in the opposite direction from curve 4, indicating that for the geometry of FIGS. 1 through 3 the *cylinder force is lower* at large scissors angles, whereas the scissors *mechanical advantage is higher* at large scissors angles. When these two characteristic curves (that is, curves 6 and 4, or curves 7 and 4) are multiplied together—as is the case when a cylinder whose characteristic resembles those in FIG. 9 is used to drive a scissors whose characteristic approaches curve 4—these opposing slants tend to cancel each other out.

Figure 9:
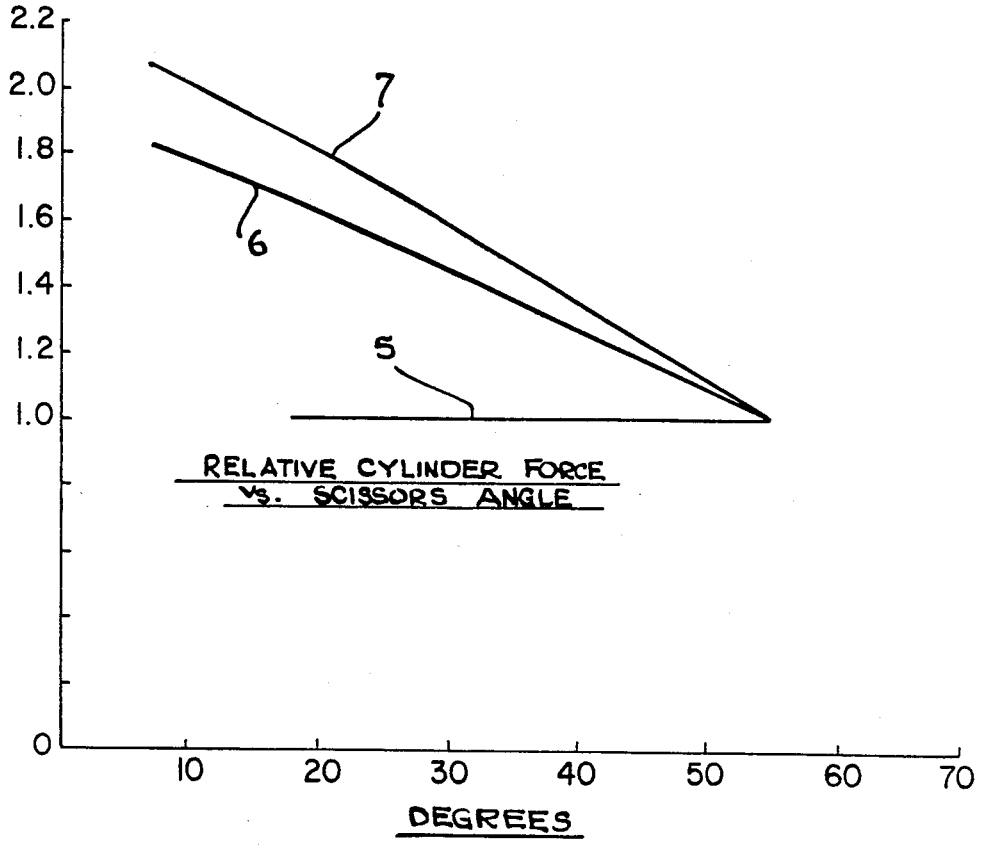
FIG. 9 is a graph showing the force at the piston of the sealed gas cylinder(s) of FIGS. 1 through 3 and 5 through 7, for three different internal configurations of the gas cylinder.

FIG. 9 is presented as "relative" cylinder force, the reference 1.0 value being the value at full cylinder extension. This value is in fact usually the nominal force value assigned to a gas cylinder. Thus the force values at positions leftward from the nominal value represent multipliers to be applied to the nominal force stated by the manufacturer for the cylinder. When these relative force values are multiplied by the mechanical-advantage values at corresponding scissors angles, the result may be called relative platform force: it is the upward force on the platform per unit *nominal* cylinder force.

For example, if a cylinder has a nominal force value of 500 pounds, its force at *full* extension (piston all the way out) is 500 pounds. In the mechanism of the preferred embodiment of the present invention, the piston is at full extension at scissors angle of fifty-five degrees, where the scissors mechanism has a mechanical advantage of 0.44 (curve 4, FIG. 8); consequently the upward platform force is 0.44 times 500 pounds, or 220 pounds. In terms of *relative* platform force, the system offers a value of $1.0\times0.44=0.44$.

The same cylinder supplies force at zero extension (piston all the way in), assuming curve 7, of 2.07 times 500 pounds, or 1,035 pounds; here, however, the mechanical advantage is only 0.21, so the force applied is 0.21 times 1,035 pounds, or 217 pounds—only *three* pounds different from the value at full extension!

In terms of relative platform force, the value is $2.07\times0.21=0.43$, extremely close to the relative force value of 0.44 found above at full extension.

Figure 10:
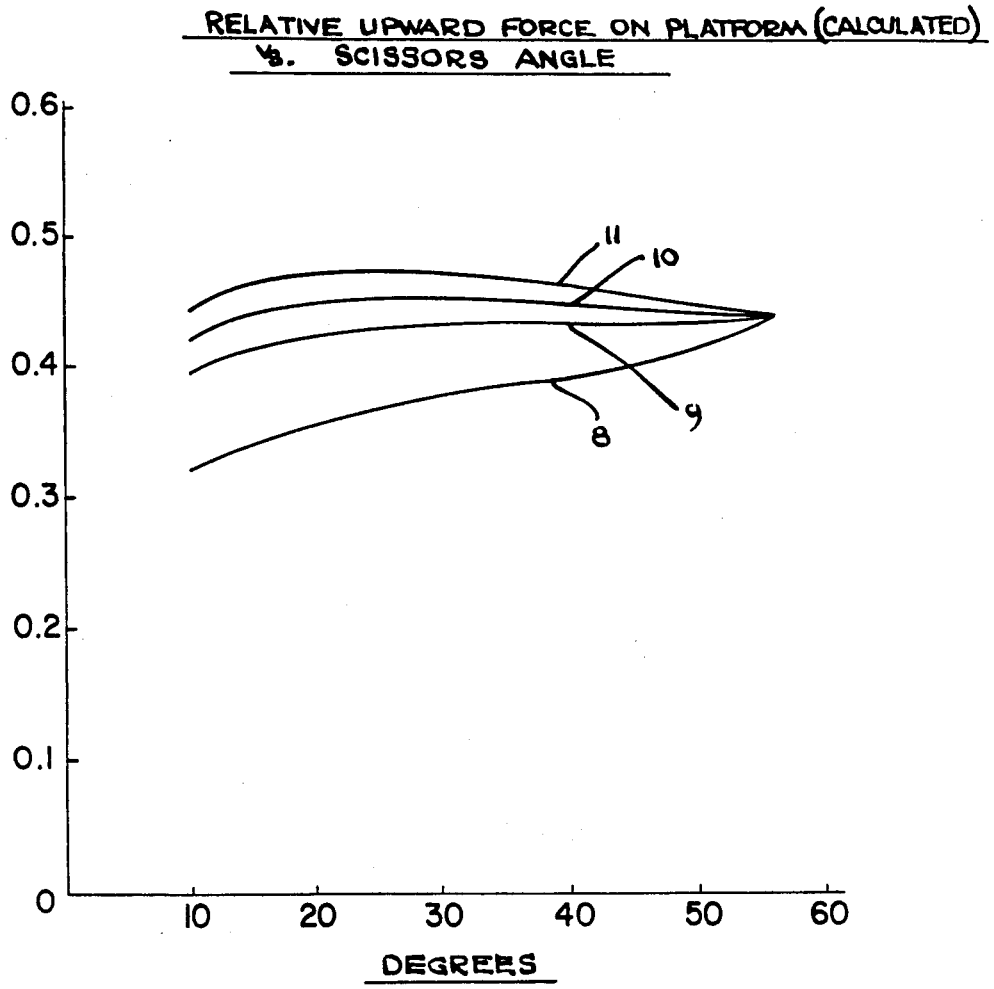
FIG. 10 is a graph showing the calculated upward force on the platform for four internal configurations of the gas cylinder, in combination with the preferred mechanical advantage of FIG. 8.

By judicious choice of parameters the overall force characteristic at the platform can be made practically flat. FIG. 10 shows several different relative-*platform*-force characteristic curves that result from combining curve 4 (FIG. 8) with different relative-cylinder-force curves. Curve 8 results from using a relative-cylinder-force characteristic that is not shown in FIG. 9, since it is not preferred, but that is relatively commonplace for other gas-cylinder applications. Its value at zero extension is about 1.51. Curve 8 rises from about 0.3 to about 0.44—really a remarkable improvement over the other systems already analyzed and described above, but only a start in terms of the potential of this area of innovation.

Curve 9 of FIG. 10 results from combining curve 4 (FIG. 8) with curve 6 (FIG. 9). This combination characteristic is a very shallow curve, varying only from 0.375 to 0.44 over the entire range of operation from seven to fifty-five degrees. Thus if the gas charge in the cylinder were chosen to generally bear a 150-pound weight at the platform with the scissors retracted, the total upward force with the scissors extended would be only:

$$0.44/0.375 \times 150 \text{ pounds} = 176 \text{ pounds},$$

an overforce of only twenty-six pounds.

Most or at least many users would be able to lean on the platform with sufficient force to lower a weight twice as heavy as the one under discussion—that is, a 300-pound combined platform weight and payweight—using the system now being described.

It would appear that the left end of the overall relative-platform-force curve could be raised even further and the behavior of the system thereby made even more desirable by using an even steeper cylinder function such as that of curve 7 in FIG. 9. This combination, as previously shown, produces platform forces only three pounds apart at the top and bottom of the operating range, for a 150-pound load.

Calculations suggest, however, that a peculiar phenomenon *may* occur when this is done: the results are plotted as curve 11 in FIG. 10. This configuration has not been tested, and it may be that the concerns or limitations discussed below do not materialize. Indeed, as anticipated, the left end of the overall platform-force function moves even closer to the right end in relative force value: the relative force at full-retracted position of the scissors is 0.43, and at the extended position (fifty-five degrees) is 0.44. It is plainly possible to exactly equalize the two, should that be desired.

The curve at intermediate scissors angles, however, is bowed quite noticeably upward as indicated by curve 11 (FIG. 10). The maximum relative force is slightly above 0.47. The corresponding overforce is not very large—only about six pounds for a 150-pound combined weight—but the "feel" as experienced by a user attempting to push the lift down might be quite different from that corresponding to curve 9. In particular, the user might notice an *increase* in the resistance to lowering the lift as he moved the platform downward; this increase would continue all the way from scissors angle of fifty-five degrees down to about twenty-five or thirty degrees. The resistance would then finally level off and decrease.

From a human-engineering standpoint this gradual increase of resistance with downward progress of the lift might be slightly annoying. Possibly it could be made less noticeable by increasing the total of the required downward force, but this simply discards the advantage offered by the force characteristic. Accordingly it may be preferable to aim for a curve such as curve 10 (FIG. 10), which results from a cylinder-force curve intermediate to curves 6 and 7 (FIG. 9).

A cylinder-force curve rising to a relative cylinder force of about 1.95 at zero extension (scissors angle seven degrees), combined with the mechanical-advantage curve 4 (FIG. 8), would produce curve 10 (FIG. 10). The upward bow of curve 10 is extremely slight, not reaching even to 0.45, and the zero-extension end (at seven degrees) is at 0.40. The overforce would be definitely larger (nineteen pounds for a 150-pound weight) at the thirty-degree mark than for curve 11, but the resulting increase of resistance with downward progress would almost surely be imperceptible.

Curve 9 appears to be very nearly the shallowest curve available which does not bow upward at intermediate angles.

As to the appearance of the apparatus that is to be made according to this preferred embodiment, FIGS. 1 through 3 illustrate it as well as the basic embodiment of the invention, since the cylinder that has been custom pressured and custom oil-filled appears externally just as a cylinder that has not been so treated. There are some differences internally. For example, the internal oil-flow-resistance apertures are advantageously made larger—so that the increased oil volume does not result in excessive speed damping. (It will be recalled that the conventional primary purpose of adding oil is to increase the damping.)

As previously indicated the analyses presented above are based upon calculations. The presentation has been made in this way simply because, and only because, the invention is particularly amenable to explanatory presentation, leading to a relatively deep level of understanding, in this way. The invention was not made, however, by doing calculations—the calculations were done subsequently—and the invention is not to be limited in any way by any of the foregoing numerical or graphic presentations.

Furthermore, devices made in accordance with the invention should not be expected to perform in close adherence to these presentations. Many departures from the theoretical may be expected to arise from geometric imperfections, from friction, "stiction," and other sources of hysteresis in the mechanism. The calculations do not account for the effective *weight* of the scissors legs and bridge, and they do not account for departures of the cylinder force characteristic from the idealized functions described.

For example, an energy-recycling scissors lift has been constructed according to the specifications that were assumed in deriving curve 9 (FIG. 10). This prototype has been subjected to very rough measurements, using informal methods and relatively elementary measuring equipment, and yielding the raw data shown plotted in FIG. 11.

In that figure, curve 12 represents measurements made while moving downward—that is to say, by using a payweight that is exceeded by the upward platform force at all positions of the scissors, and by applying downward force to a scale placed atop the payweight and recording the scale indication at various points in the downward progress. Curve 13 represents similar measurements made while moving upward—that is to say, by using a payweight that exceeds the upward platform force, and by applying upward force via a spring scale to the platform and observing the scale reading at various points in the upward progress.

The curves suggest a considerable amount of hysteresis, and their shapes do not closely conform to those in FIG. 10 generally—or to curve 9 in particular. In fact curves 12 and 13 are concave upward whereas curve 9 is, if anything, concave downward. Nevertheless curves 12 and 13, and especially curve 13, are strikingly similar to curve 9 in that (1) both are very generally flat and (2) both vary between about 0.38 and values slightly above 0.4—namely, 0.41 for curve 13, and 0.44 for curve 9.

In view of the ultimately practical object of the invention and the many sources of discrepancy enumerated above, the agreement with the analytical values seems very satisfactory. Moreover, the performance of the prototype mentioned, and other prototypes that have also been made and put into use, completely satisfies all the objectives described in the introductory parts of this document.

Figure 11:
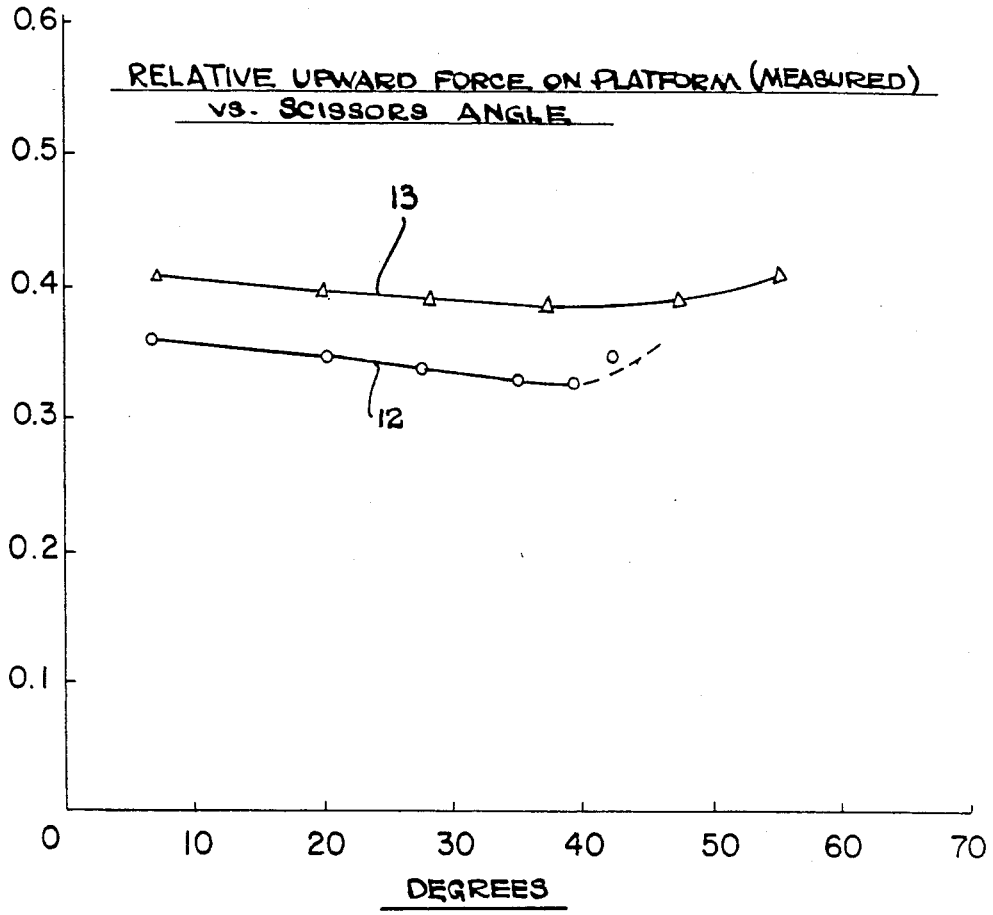
FIG. 11 is a graph showing the results of rough measurements of the upward force on the platform, for one gas-cylinder configuration, in combination with the scissors configuration that yields the preferred mechanical-advantage curve of FIG. 8.

Both of the curves in FIG. 11, as well as all of the curves in FIG. 10, represent performance exceeding any of the previously discussed embodiments, by virtue of the smaller force variations—and also by virtue of the simplicity of the mechanical system. A single scissors-lift mechanism can be made to serve a very wide range of payweights, and involves only one component that varies from one payweight to another—namely, the custom-pressured and custom-oil-filled gas cylinder. Installation of that one component is a matter of a minute's work. Hence warehousing and other manufacturing costs can be kept to an absolute minimum, and labor costs, including those at final assembly, are minimal.

As can now be seen, all of the embodiments of the invention provide faster, smoother and quieter operation than previous units that are powered up by hydraulic, pneumatic or electrical systems. The several embodiments of the invention are also lighter and simpler to ship and to maintain: there is only one part that is significantly subject to failure, and that part is quite inexpensive and has a normal replacement schedule that runs in terms of years at the least.

Figure 12:
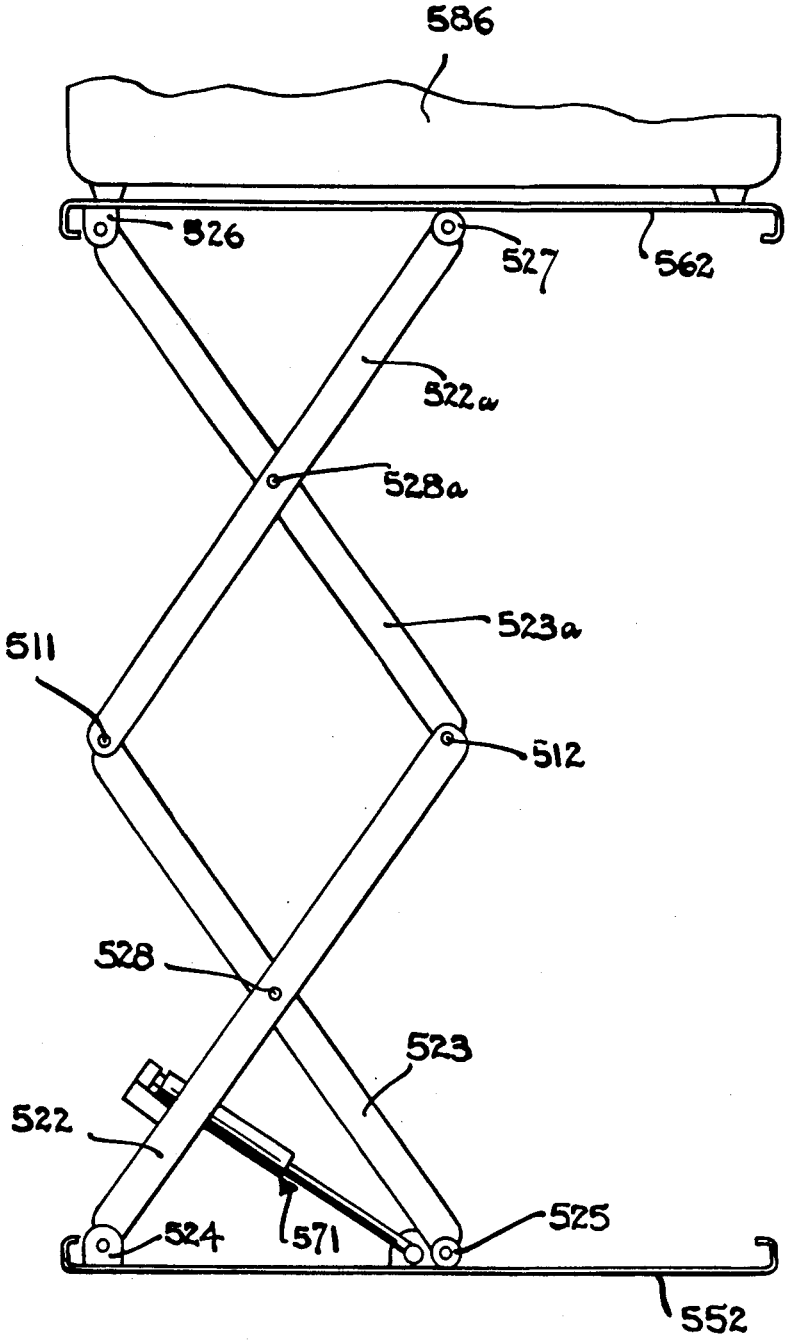
FIG. 12 is side elevation, similar to those of FIGS. 2, 3, 6 and 7, showing an alternative embodiment of the invention that incorporates a two-stage scissors mechanism.

The only significant compromise made in developing the preferred embodiment described was, as will be recalled, in the length of the platform stroke. Ample stroke, however, can be obtained as a variant embodiment of the most highly preferred embodiment described above (or any of the other important embodiments), by using a two-stage scissors, as shown in FIG. 12. In this drawing the top ends of the bottom-stage legs 522 an 523 are pivotally secured to the bottom ends of the top-stage legs **522*a* and 523*a*, by pivot pins 511 and 512. The other reference numerals in FIG. 12 are similar to those used for analogous components shown in earlier drawings, with the addition of or change to a suffix "5". The cylinder 571** shown here may be custom pressured and custom oil-filled as already described (or other equalizing/compensating means may be used instead).

Yet another embodiment of my invention encompasses having custom-made a sealed gas cylinder whose dimensions—both on an absolute and on a relative basis—provide precisely the cylinder force-versus-travel characteristic that is required for a particular high-manufacturing-volume application, *without* addition of oil other than what is required for sealing and lubrication.

The invention is not limited to the use of sealed gas cylinders as energy-storing means. Based upon the extensive understanding of the invention that has been gained through working with gas cylinders, and which has been presented above, it is believed that for some applications the principles of the invention can be successfully applied using springs or other energy-storage means instead of gas cylinders. For instance, the use of plural, parallel springs that come into play at respective different regions of the operating range of the scissors—similar to the parallel-cylinder embodiment described above—would appear to make possible other embodiments of the invention having some of the advantages of the already-detailed embodiments.

Thus, there has been illustrated and described a unique and novel energy-recycling scissors lift which fulfills all the objects and advantages set forth. It should be understood that many changes, modifications, variations and other uses and applications will be become apparent to those skilled in the art after considering this disclosure and the accompanying drawings. Therefore, any and all such changes, modifications, variations, and other uses and applications which do not depart from the spirit and scope of the invention are deemed to be covered by the invention which is limited only by the following claims.

What is claimed is:

1. An energy-recycling scissors lift for raising and lowering an article comprising:

a lower support member and upper support member, said upper support member being adapted for vertical motion between a relatively retracted position and a relatively extended position above said lower support member, said upper support member being adapted to hold the article;

a scissors linkage including a first and second scissors leg, said first scissors leg having one end that is pivotally connected to said upper support member and another end that translates along said lower suport member while in operation, said second scissors leg having one end that is pivotally connected to said lower support member and another end that translates along said upper member while in operation;

attachment-structure means secured to said second scissors leg;

a sealed gas cylinder hasving a first end that is pivotally fixed to said attachment-structure means and a second end that is pivotally attached to said lower support member, said sealed gas cylinder being adapted for storing energy when the article and said upper support member is lowered to a retracted position and for moving said upper support member and the article upwardly from said retracted position toward said extended position; and means for compensating for the force exerted on said upper support member by said sealed gas cylinder.

2. The energy-recycling scissors lift as defined in claim 1 wherein said upper support member is a platform adapted to hold the article and said lower support member is a base.

3. The energy-recycling scissors lift as defined in claim 2 wherein said scissors legs are pivotally connected substantially at their midpoints for mutual rotation.

4. The energy-recycling scissors lift as defined in claim 3, also comprising:

a second scissors linkage substantially identical to said first mentioned scissors linkage, said second scissors linkage being substantially identically disposed and attached to said support members and to said attachment-structure means, but which is offset from the previously recited scissors mechanism in a direction perpendicular to the direction of translation of any one of said scissors leg ends which translate along said support members.

5. The energy-recycling scissors lift as defined in claim 4, wherein:

said scissors legs of said second scissors mechanism are pivotally connected substantially at their mid-points for mutual rotation.

6. The energy-recycling scissors lift as defined in claim 5, wherein:

said attachment-structure means comprises a bridge structure attached to each of said second scissors legs of said scissors mechanisms.

7. The energy-recycling scissors lift as defined in claim 2, wherein:

the attachment-structure means are disposed at an offset radius that is roughly one-fourth the length of each scissors leg, as measured from the pivotal attachment of the second scissors leg to said base.

8. The energy-recycling scissors lift as defined in claim 3, wherein:

each of said ends of said scissors legs which translates along said base and platform has a roller means rotatably mounted to said ends for rolling engagement with said base and platform.

9. The energy-recycling scissors lift as defined in claim 8 wherein:

said base and said platform includes a pair of vertical sidewalls extending along the line of translation of each of said first scissors legs, each of said sidewalls having a horizontal piece, wherein each of said sidewalls and horizontal pieces defining a channel for said roller means to translate therein.

10. The energy-recycling lift as defined in claim 9 wherein said compensating means further comprises:

a weight adjustment mechanism affixed to said attachment-structure means and affixed to one end of said sealed gas cylinder, said weight adjustment mechanism having means for adjusting the position of said end of said sealed gas cylinder.

11. The energy-recycling lift as defined in claim 10 wherein:

said weight adjustment mechanism comprises:

a housing assembly having a slot defined therein;

a jack screw rotatably affixed within said housing assembly; and a clevis affixed to said jack screw, said clevis being located within said housing assembly and adapted for movement within said housing assembly when said jack screw is rotated, said clevis having a bore for receiving a fastener means that fastens said end of said sealed gas cylinder, said bore being movable within said slot on said housing assembly.

12. The energy-recycling scissors lift as defined in claim 11 wherein:

said slot on said housing assembly is about one and one half inches long.

13. The energy-recycling scissors lift as defined in claim 10 wherein:

each of said vertical side walls on said base has a plurality of bores adapted for receiving a stopper means that prevents said scissors leg from further translating along said base.

14. The energy-recycling scissors lift as defined in claim 13 further including:

a boss attached to said base, wherein said end of said sealed gas cylinder is fixed to said boss by fastener means and said boss has a "J" shaped slot defined therein which extends horizontally from one end of said boss to the other end wherein said slot extends downward to a vertical position, a portion of said slot defining a retaining notch which is adapted for receiving said fastener means.

15. The energy-recycling scissors lift as defined in claim 3 also comprising:

a low force prime mover such as a small electrical motor connected to said platform for controlling the motion of said platform.

16. The energy-recycling scissors lift as defined in claim 3 also comprising:

a low force prime mover such as a hydraulic cylinder connected to said platform for controlling the motion of said platform.

17. The energy-recycling scissors lift as defined in claim 3 also comprising:

a low force prime mover such as pneumatic cylinder connected to said platform for controlling the motion of said platform.

18. The energy-recycling scissors lift as defined in claim 2, also comprising:

a second scissors linkage substantially identical to said first mentioned scissors linkage, said second scissors linkage being substantially identically disposed and attached to said support members and to said attachment-structure means but which is offset from the first recited scissors linkage in a direction perpendicular to the direction of translation of any one of said scissors legs ends which translate along said support members.

19. The energy-recycling scissors lift as defined in claim 18, wherein:

each of said ends of said scissors legs which translates along said base and platform has a roller means rotatably mounted to said ends for rolling engagement with said base and platform.

20. The energy-recycling scissors lift as defined in claim 19 wherein:

said base and said platform includes a pair of vertical sidewalls extending along the line of translation of each of said first scissors legs, each of said sidewalls having a horizontal piece wherein each of such sidewalls and horizontal pieces defining a channel for said roller means to translate therein.

21. The energy-recycling lift as defined in claim 20 wherein said compensating means further comprises:

a weight adjustment mechanism affixed to said attachment-structure means and affixed to one end of said sealed gas cylinder, said weight adjustment mechanisms having means for adjusting the position of said end of said sealed gas cylinder.

22. The energy-recycling lift as defined in claim 21 wherein:

said weight adjustment mechanism comprises:

a housing assembly having a slot defined therein;

a jack screw rotatably affixed within said housing assembly; and a clevis affixed to said jack screw, said clevis being located within said housing assembly and adapted for movement within said housing assembly when said jack screw is rotatable, said clevis having a bore for receiving a fastener means that fastens said end of said sealed gas cylinder, said bore being movable within said slot on said housing assembly.

23. The energy-recycling scissors lift as defined in claim 22 wherein:

said slot on said housing assembly is about one and one half inches long.

24. The energy-recycling scissors lift as defined in claim 21 wherein:

each of said vertical side walls on said base has a plurality of bores adapted for receiving a stopper means that prevents said scissors leg from further translating along said base.

25. The energy-recycling scissors lift as defined in claim 24 further including:

a boss attached to said base, wherein said end of said sealed gas cylinder is fixed to said boss by fastener means and said boss has a "J" shaped slot defined therein which extends horizontally from one end of said boss to the other end wherein said slot extends downward to a vertical position, a portion of said slot defining a retaining notch which is adapted for receiving said fastener means.

26. The energy-recycling scissors lift as defined in claim 25 also comprising:

a low force prime mover such as a small electrical motor connected to said platform for controlling the motion of said platform.

27. The energy-recycling scissors lift as defined in claim 25 also comprising:

a low force prime mover such as a hydraulic cylinder connected to said platform for controlling the motion of said platform.

28. The energy-recycling scissors lift as described in claim 25 also comprising:

a low force prime mover such as pneumatic cylinder connected to said platform for controlling the motion of said platform.

29. The energy-recycling scissors lift as defined in claim 1 wherein:

said compensating means comprises an equalizing spring having one end attached to said pivotally fixed end of said first scissors leg and another end attached to said end of said second leg which translates along said platform.

30. The energy-recycling scissors lift as defined in claim 1 wherein said compensating means comprises:

a spring reel attached to said base having an end attached to said platform, said spring reel being adapted for importing a downward force on said platform.

31. The energy-recycling lift as defined in claim 1 wherein said compensating means further comprises:

a weight adjustment mechanism affixed to said attachment-structure means and affixed to one end of said sealed gas cylinder, said weight adjustment mechanism having means for adjusting the position of said end of said sealed gas cylinder.

32. The energy-recycling lift as defined in claim 31 wherein:

said weight adjustment mechanism comprises: a housing assembly having a slot defined therein; a jack screw rotatably affixed within said housing assembly; and a clevis affixed to said jack screw, said clevis being located within said housing assembly and adapted for movement within said housing assembly when said jack screw is rotated, said clevis having a bore for receiving a fastener means that fastens said end of said sealed gas cylinder, said bore being movable within said slot on said housing assembly.

33. The energy-recycling scissors lift as defined in claim 32 wherein:

said slot on said housing assembly is about one and one half inches long.

34. The energy-recycling scissors lift as defined in claim 31 further including:

a boss attached to said lower support member, wherein said end of said sealed gas cylinder is fixed to said boss by fastener means and said boss has a "J" shaped slot defined therein which extends horizontally from one end of said boss to the other end wherein said slot extends downward to a vertical position, a portion of said slot defining a retaining notch which is adapted for receiving said fastener means.

35. The energy-recycling scissors lift as defined in claim 34 wherein:

each end of said scissors legs which translates along said upper and lower support members includes roller means for rolling engagement with said upper and lower support members, said lower support member including a pair of vertical sidewalls extending along the line of translation of said first scissors leg, said vertical sidewalls defining a channel for said roller means to translate therein, said vertical sidewalls also including a plurality of bores adapted for receiving stopper means that prevent said first scissors leg from further translating along said lower support member.

* * * * *